US011011129B2

(12) United States Patent
Park et al.

(10) Patent No.: US 11,011,129 B2
(45) Date of Patent: May 18, 2021

(54) DISPLAY DEVICE

(71) Applicant: LG Display Co., Ltd., Seoul (KR)

(72) Inventors: JinWoo Park, Seoul (KR); Seokyu Jang, Goyang-si (KR); ChangBok Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/846,525

(22) Filed: Dec. 19, 2017

(65) Prior Publication Data

US 2019/0066620 A1 Feb. 28, 2019

(30) Foreign Application Priority Data

Aug. 31, 2017 (KR) ..... 10-2017-0111274

(51) Int. Cl.
*G09G 3/36* (2006.01)
*G09G 3/3266* (2016.01)

(52) U.S. Cl.
CPC ..... *G09G 3/3688* (2013.01); *G09G 3/3266* (2013.01); *G09G 3/3611* (2013.01); *G09G 3/3677* (2013.01); *G09G 2300/0408* (2013.01); *G09G 2310/0286* (2013.01);
(Continued)

(58) Field of Classification Search
CPC ..... G09G 2310/0286; G09G 2310/08; G09G 3/3266; G09G 3/3674; G09G 2310/0283; G09G 2310/0262; G09G 2310/0281; G09G 2310/02; G09G 2310/0202; G09G 2310/0237; G09G 5/12; G09G 2310/0208; G09G 3/3648; G09G 3/3688; G09G 3/3611; G09G 3/3677; G09G 2320/045;
(Continued)

(56) References Cited

U.S. PATENT DOCUMENTS 4,200,868 A * 4/1980 Lamoureux ..... G09G 3/291 345/208
5,515,080 A * 5/1996 Nakamura ..... G09G 3/3648 345/534
(Continued)

FOREIGN PATENT DOCUMENTS

CN 1704804 A 12/2005
CN 102214430 A 10/2011
(Continued)

OTHER PUBLICATIONS

First Notification of Office Action dated Mar. 25, 2021, issued in corresponding Chinese Patent Application No. 201711193829.8.

*Primary Examiner* — Michael J Jansen, II
(74) *Attorney, Agent, or Firm* — Morgan, Lewis & Bockius LLP

(57) ABSTRACT

Disclosed is a display device which is capable of increasing a lifespan of a gate driver by maintaining a deterioration balance among a plurality of pull-down transistors, wherein the display device may include a display panel for displaying an image, a gate driver for supplying a gate signal to the display panel, and a timing controller for supplying a gate driver control signal to the gate driver, wherein the timing controller is set in such a way that it is turned-off until after a predetermined one among the plurality of pull-down transistors inside the gate driver is driven by the use of reset signal supplied from a reset integrated circuit.

16 Claims, 8 Drawing Sheets

(52) U.S. Cl.
CPC ... *G09G 2310/061* (2013.01); *G09G 2310/08* (2013.01); *G09G 2320/045* (2013.01)

(58) Field of Classification Search
CPC ..... G09G 2310/061; G09G 2300/0408; G09G 3/3225; H04N 5/3765
See application file for complete search history.

(56) References Cited

U.S. PATENT DOCUMENTS 6,335,717 B2 * 1/2002 Hasegawa ..... G09G 3/3648 345/97
7,271,801 B2 * 9/2007 Toyozawa ..... G09G 3/3648 345/100
7,391,405 B2 * 6/2008 Ahn ..... G09G 5/006 345/100
7,595,783 B2 * 9/2009 Cho ..... G11C 19/00 345/100
7,649,971 B2 * 1/2010 Kim ..... G11C 19/28 377/64
7,698,573 B2 * 4/2010 Yamato ..... G09G 3/3696 345/211
7,714,819 B2 * 5/2010 Kawaguchi ..... G02F 1/13306 345/204
7,852,305 B2 * 12/2010 Tsai ..... G09G 3/20 345/211
7,859,507 B2 * 12/2010 Jang ..... G09G 3/3677 345/100
7,907,113 B2 * 3/2011 Jang ..... G09G 3/3607 345/100
8,004,645 B2 * 8/2011 Park ..... G02F 1/13452 345/104
8,019,905 B2 * 9/2011 Wu ..... G09G 5/006 345/214
8,049,704 B2 * 11/2011 Jang ..... G09G 3/3677 345/100
8,120,553 B2 * 2/2012 Kim ..... G09G 3/3233 315/169.3
8,125,424 B2 * 2/2012 Hong ..... G09G 3/3648 345/87
8,188,963 B2 * 5/2012 Park ..... G09G 3/3648 345/99
8,232,941 B2 * 7/2012 Yeo ..... G09G 3/3677 345/100
8,253,721 B2 * 8/2012 Lee ..... G09G 3/3696 345/212
8,274,460 B2 * 9/2012 Moon ..... G09G 3/3648 345/100
8,373,638 B2 * 2/2013 Jang ..... G09G 3/3607 345/100
8,432,343 B2 * 4/2013 Hong ..... G09G 3/3677 345/204
8,493,291 B2 * 7/2013 Nam ..... G09G 3/3614 345/213
8,686,935 B2 * 4/2014 Jo ..... G09G 3/3614 345/87
8,933,914 B2 * 1/2015 Kim ..... G09G 3/3614 345/204
8,952,948 B2 * 2/2015 Moon ..... G09G 3/3648 345/208
8,976,106 B2 * 3/2015 So ..... G11C 19/28 345/103
9,013,382 B2 * 4/2015 Do ..... G09G 3/3655 345/33
9,013,390 B2 * 4/2015 Yang ..... G09G 3/3677 345/100
9,047,823 B2 * 6/2015 Kim ..... G09G 3/3233
9,086,682 B2 * 7/2015 Choe ..... G03H 1/2294
9,106,209 B2 * 8/2015 Kang ..... G09G 3/3677
9,123,310 B2 * 9/2015 Choi ..... G09G 3/3696
9,165,520 B2 * 10/2015 Kim ..... G09G 3/3677
9,251,735 B2 * 2/2016 Mun ..... G09G 3/3266
9,275,597 B2 * 3/2016 Miyatake ..... G09G 3/3225
9,444,450 B2 * 9/2016 Xiao ..... H03K 17/687
9,495,930 B2 * 11/2016 Zheng ..... G11C 19/28
9,640,130 B2 * 5/2017 Sugiyama ..... G09G 3/3677
9,741,301 B2 * 8/2017 Yu ..... G09G 3/3648
9,774,325 B2 * 9/2017 Kim ..... G09G 3/3225
9,847,068 B2 * 12/2017 Dai ..... G09G 3/3677
9,865,194 B2 * 1/2018 Koo ..... G09G 3/20
9,892,676 B2 * 2/2018 Cao ..... G09G 3/3225
9,922,591 B2 * 3/2018 Ko ..... G11C 19/28
9,997,136 B2 * 6/2018 Cao ..... G11C 19/287
10,008,152 B2 * 6/2018 Jang ..... G09G 3/3258
10,115,366 B2 * 10/2018 Choi ..... G09G 3/3696
10,147,374 B2 * 12/2018 Ko ..... G09G 3/3648
10,417,977 B2 * 9/2019 Zhao ..... G09G 3/3677
2001/0011979 A1 * 8/2001 Hasegawa ..... G09G 3/3648 345/87
2002/0089484 A1 * 7/2002 Ahn ..... G09G 5/006 345/98
2003/0184538 A1 * 10/2003 Yamato ..... G09G 3/3696 345/211
2004/0041760 A1 * 3/2004 Tsumura ..... G09G 3/342 345/87
2004/0104908 A1 * 6/2004 Toyozawa ..... G09G 3/3648 345/211
2005/0078076 A1 * 4/2005 Kim ..... G09G 3/3677 345/98
2006/0007096 A1 * 1/2006 Kawaguchi ..... G02F 1/13306 345/102
2006/0145991 A1 * 7/2006 Jang ..... G09G 3/3677 345/94
2006/0145999 A1 * 7/2006 Cho ..... G11C 19/28 345/100
2007/0001953 A1 * 1/2007 Jang ..... G09G 3/3607 345/88
2007/0001991 A1 * 1/2007 Jang ..... G09G 3/3677 345/100
2007/0285363 A1 * 12/2007 Do ..... G09G 3/3655 345/87
2008/0122824 A1 * 5/2008 Lee ..... G09G 3/3696 345/211
2008/0129652 A1 * 6/2008 Park ..... G09G 3/3648 345/55
2008/0129903 A1 * 6/2008 Hong ..... G09G 3/3648 349/36
2008/0136756 A1 * 6/2008 Yeo ..... G09G 3/3677 345/87
2008/0150860 A1 * 6/2008 Hong ..... G09G 3/3677 345/87
2008/0180364 A1 * 7/2008 Kim ..... G09G 3/3233 345/76
2008/0204390 A1 * 8/2008 Moon ..... G09G 3/3648 345/87
2008/0218647 A1 * 9/2008 Park ..... G02F 1/13452 349/37
2008/0238852 A1 * 10/2008 Tsai ..... G09G 3/20 345/98
2008/0278467 A1 * 11/2008 Hwang ..... G09G 3/3648 345/205
2009/0080593 A1 * 3/2009 Kim ..... G09G 3/006 377/75
2009/0195529 A1 * 8/2009 Nam ..... G09G 3/3614 345/213
2009/0201312 A1 * 8/2009 Wu ..... G09G 5/006 345/619
2011/0157107 A1 * 6/2011 Jo ..... G02F 1/136286 345/204
2011/0169874 A1 * 7/2011 Jang ..... G09G 3/3607 345/690
2011/0234554 A1 9/2011 Yoshii et al.
2012/0001894 A1 * 1/2012 Kim ..... G11C 19/28 345/213
2012/0044225 A1 * 2/2012 Kim ..... G09G 3/3614 345/209
2012/0133627 A1 * 5/2012 Moon ..... G09G 3/3648 345/208

(56) References Cited

U.S. PATENT DOCUMENTS

2013/0027377 A1* 1/2013 Yang ..... G09G 3/3677 345/212
2013/0100181 A1* 4/2013 Choe ..... G03H 1/2294 345/691
2013/0234919 A1* 9/2013 Choi ..... G09G 3/3655 345/92
2013/0249872 A1* 9/2013 Kang ..... G09G 3/3677 345/204
2014/0085280 A1* 3/2014 Saitoh ..... G09G 3/3648 345/204
2014/0092082 A1* 4/2014 Choi ..... G09G 3/3696 345/213
2014/0092144 A1* 4/2014 Kim ..... G09G 3/3233 345/690
2014/0104152 A1* 4/2014 Ma ..... G09G 3/3677 345/100
2014/0118327 A1* 5/2014 So ..... G11C 19/28 345/212
2014/0152629 A1 6/2014 So et al.
2014/0168282 A1* 6/2014 Mun ..... G09G 3/3266 345/690
2014/0186665 A1 7/2014 Takeyama
2014/0285413 A1* 9/2014 Miyatake ..... G09G 3/3225 345/87
2015/0061985 A1* 3/2015 Sugiyama ..... G09G 3/3677 345/87
2015/0187304 A1* 7/2015 Ko ..... G09G 3/3688 345/208
2015/0302813 A1* 10/2015 Yu ..... G09G 3/3648 345/204
2015/0339999 A1* 11/2015 Zheng ..... G11C 19/28 345/92
2015/0340003 A1* 11/2015 Choi ..... G09G 3/3696 345/92
2015/0371598 A1 12/2015 So et al.
2016/0164514 A1* 6/2016 Xiao ..... H03K 17/687 327/109
2016/0182042 A1* 6/2016 Kim ..... G09G 3/3225 345/213
2016/0189624 A1* 6/2016 Jang ..... G09G 3/3696 345/213
2016/0189677 A1* 6/2016 Cao ..... G11C 19/287 345/691
2016/0196789 A1* 7/2016 Suyama ..... G09G 3/3614 345/209
2016/0247446 A1* 8/2016 Cao ..... G09G 3/3225
2016/0260405 A1* 9/2016 Dai ..... G09G 3/3677
2016/0372077 A1* 12/2016 Koo ..... G09G 3/20
2017/0154567 A1* 6/2017 Ko ..... G11C 19/28
2018/0330678 A1* 11/2018 Zhao ..... G09G 3/3607
2019/0147795 A1 5/2019 Yao

FOREIGN PATENT DOCUMENTS

CN 103430033 A 12/2013
CN 103854585 A 6/2014
CN 105206210 A 12/2015
CN 105938703 A 9/2016

* cited by examiner

DISPLAY DEVICE

CROSS REFERENCE TO RELATED APPLICATIONS

This application claims the benefit of the Korean Patent Application No. 10-2017-0111274 filed on Aug. 31, 2017, which is hereby incorporated by reference as if fully set forth herein.

BACKGROUND

Technical Field

Embodiments of the present disclosure relate to a display device.

Discussion of the Related Art

With the advancement of an information-oriented society, various technologies related with a display device for displaying an image or picture of visual information have been developed and studied. The display device may include a display panel, a gate driver, a data driver, a timing controller, and a set. The display panel includes gate lines, data lines, and a plurality of pixels which are provided at intersections of the gate and data lines and are supplied with data voltages of the data lines when gate signals are supplied to the gate lines.

The gate driver supplies the gate signals to the gate lines. The data driver includes a source driver integrated circuit (hereinafter, referred to as "source driver IC") for supplying the data voltages to the data lines. The timing controller controls an operation timing of each of the gate driver and the data driver, and supplies digital video data to the data driver.

For driving the display device, the gate driver turns on/off a pull-up transistor for supplying a gate-on voltage to the gate lines and a pull-down transistor for supplying a gate-off voltage to the gate lines. For driving the display device, a turn-on time period of the pull-down transistor is relatively longer than a turn-on time period of the pull-up transistor. In this case, the pull-down transistor deteriorates most rapidly. In order to overcome this problem, the plurality of pull-down transistors may be prepared. For example, the gate driver may be provided with the first and second pull-down transistors arranged in parallel.

In case of the related art, if the display device is turned-on, the first pull-down transistor is turned-on earlier than the second pull-down transistor. Accordingly, the first pull-down transistor deteriorates most rapidly. According as an alternating cycle of the first pull-down transistor and the second pull-down transistor is increased, it is difficult to maintain a balance between a deterioration level of the first pull-down transistor and a deterioration level of the second pull-down transistor. If a deterioration level balance is not maintained in the plurality of pull-down transistors, a lifespan of the gate driver becomes shortened.

SUMMARY

Accordingly, embodiments of the present disclosure are directed to a display device that substantially obviates one or more problems due to limitations and disadvantages of the related art.

An aspect of the present disclosure is to provide a display device that is capable of increasing a lifespan of a gate driver by maintaining a deterioration balance among a plurality of pull-down transistors.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, a display device comprises a display panel for displaying an image; a gate driver for supplying a gate signal to the display panel; and a timing controller for supplying a gate driver control signal to the gate driver, wherein the timing controller is set in such a way that it is turned-off until after a predetermined one among a plurality of pull-down transistors inside the gate driver is driven by the use of reset signal supplied from a reset integrated circuit.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated and constitute a part of this application, illustrate embodiments of the disclosure and together with the description serve to explain various principles. In the drawings.

DETAILED DESCRIPTION

Figure 1:
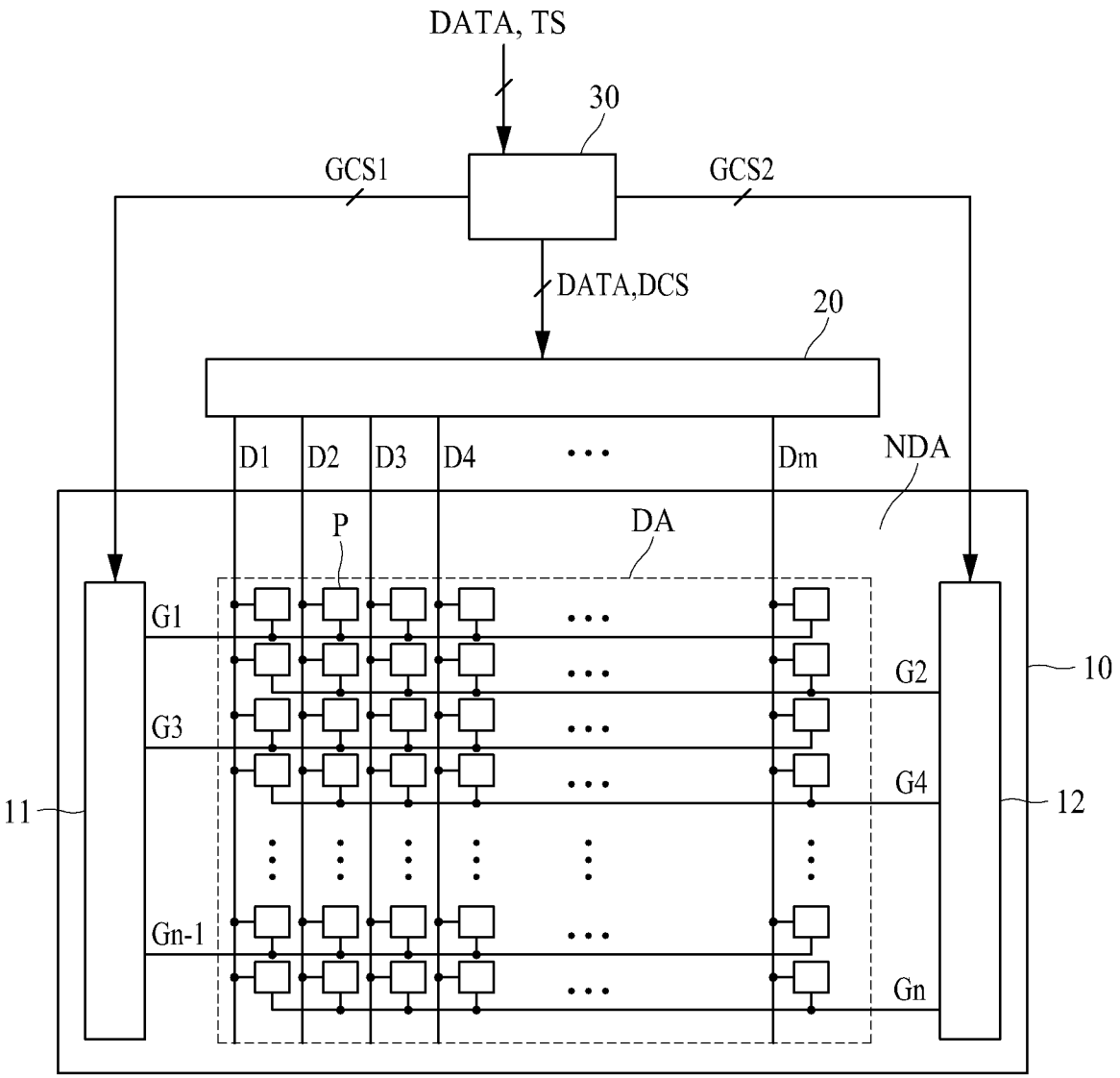
FIG. 1 is a block diagram illustrating a display device according to the present disclosure.

Reference will now be made in detail to exemplary embodiments of the present disclosure, examples of which are illustrated in the accompanying drawings. Wherever possible, the same reference numbers will be used throughout the drawings to refer to the same or like parts. Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only~' is used. The terms of a singular form may include plural forms unless referred to the contrary.

In construing an element, the element is construed as including an error region although there is no explicit description.

In describing a position relationship, for example, when the positional order is described as 'on~', 'above~', 'below~', and 'next~', a case which is not contact may be included unless 'just' or 'direct' is used.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

Also, "first horizontal axis direction", "second horizontal axis direction", and "vertical axis direction" are not limited to a perpendicular geometric configuration. That is, "first horizontal axis direction", "second horizontal axis direction", and "vertical axis direction" may include an applicable wide range of a functional configuration.

Also, it should be understood that the term "at least one" includes all combinations related with any one item. For example, "at least one among a first element, a second element and a third element" may include all combinations of two or more elements selected from the first, second and third elements as well as each element of the first, second and third elements. Also, if it is mentioned that a first element is positioned "on or above" a second element, it should be understood that the first and second elements may be brought into contact with each other, or a third element may be interposed between the first and second elements.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, a display device according to embodiments of the present disclosure will be described in detail with reference to the accompanying drawings.

Figure 2:
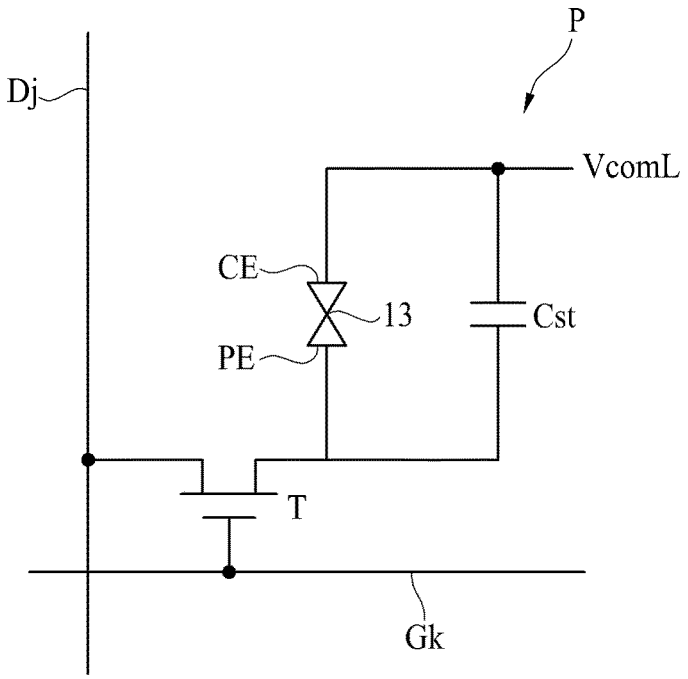
FIG. 2 is a circuit diagram illustrating one example of a pixel according to the present disclosure.
Figure 3:
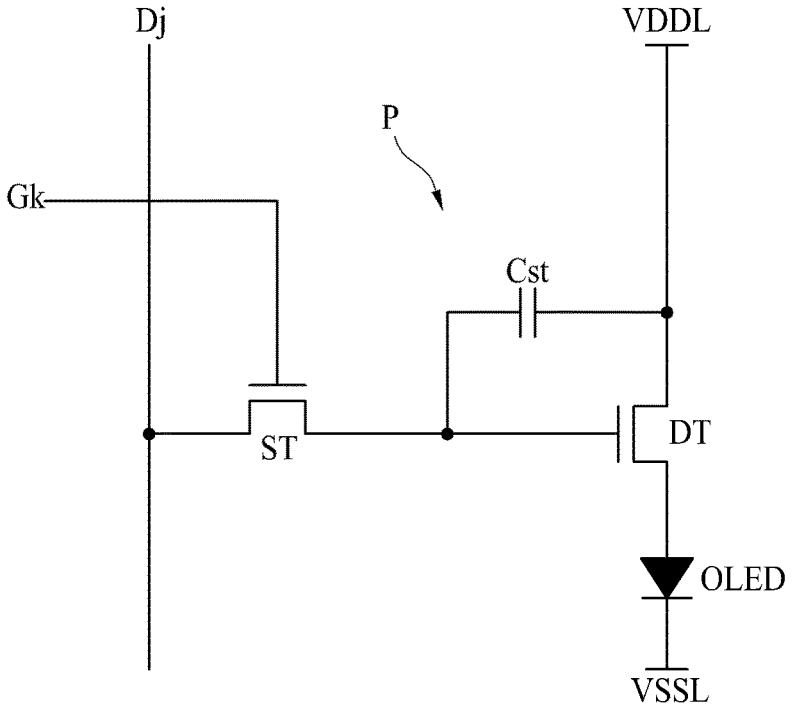
FIG. 3 is a circuit diagram illustrating another example of a pixel according to the present disclosure.

FIG. 1 is a block diagram illustrating a display device according to the present disclosure. FIG. 2 is a circuit diagram illustrating one example of a pixel according to the present disclosure. FIG. 3 is a circuit diagram illustrating another example of a pixel according to the present disclosure.

The display device according to the present disclosure may include a display panel 10, first and second gate drivers 11 and 12, a data driver 20, and a timing controller 30.

The display device according to the present disclosure may be any display device capable of supplying data voltage to pixels (P) in a line sequential scanning method of supplying gate signals to gate lines (G1~Gn, 'n' is an integer of 2 or more than 2). For example, the display device according to the present disclosure may be applied to a liquid crystal display device or an organic light emitting display device.

The display panel 10 displays an image by the use of plurality of pixels (P). The display panel 10 may include a display area (DA) and a non-display area (NDA). The display area (DA) is prepared with the plurality of pixels (P), and an image is displayed on the display area (DA). The non-display area (NDA) is prepared in the periphery of the display area (DA), and an image is not displayed on the non-display area (NDA). Each of the pixels (P) may be connected with any one of data lines (D1~Dm), and any one of the gate lines (G1~Gn). When the gate signal is supplied to the gate line, the data voltage is supplied to the data line. The pixel (P) emits light with a predetermined brightness.

If the display device is applied to the liquid crystal display device, each of the pixels (P) may include a transistor (T), a pixel electrode (PE), and a storage capacitor (Cst), as shown in FIG. 2. The transistor (T) supplies the data voltage of the data line (Dj, herein, 'j' is an integer satisfying $1 \leq j \leq m$) to the pixel electrode (PE) in response to the gate signal of the gate line (Gk, herein, 'k' is an integer satisfying $1 \leq k \leq n$). Thus, each of the pixels (P) drives liquid crystal of a liquid crystal layer 13 by an electric field formed by a potential difference between the data voltage supplied to the pixel electrode (PE) and a common voltage supplied to a common electrode (CE), to thereby control a transmittance of incident light provided from a backlight unit. The common electrode (CE) is supplied with the common voltage through a common voltage line (VcomL), and the backlight unit is disposed under the display panel 10 so as to provide uniform light to the display panel 10. Also, the storage capacitor (Cst) is prepared between the pixel electrode (PE) and the common electrode (CE) so as to maintain the constant potential difference between the pixel electrode (PE) and the common electrode (CE).

If the display device is applied to the organic light emitting display device, each of the pixels (P) may include an organic light emitting diode (OLED), a scan transistor (ST), a driving transistor (DT), and a storage capacitor (Cst), as shown in FIG. 3. The scan transistor (ST) supplies the data voltage of the j-th data line (Dj) to a gate electrode of the driving transistor (DT) in response to the gate signal of the k-th gate line (Gk). The driving transistor (DT) controls a driving current which flows from a high potential voltage line (VDDL) to the organic light emitting diode (OLED) in accordance with the data voltage supplied to the gate electrode. The organic light emitting diode (OLED) is prepared between the driving transistor (DT) and a low potential voltage line (VSSL), wherein the organic light emitting diode (OLED) emits light with a predetermined brightness in accordance with the driving current. The storage capacitor (Cst) may be prepared between the gate electrode of the driving transistor (DT) and the high potential voltage line (VDDL) so as to maintain a constant voltage in the gate electrode of the driving transistor (DT).

The first gate driver 11 is connected with the odd-numbered gate lines (G1, G3, . . . , Gn−1). The first gate driver 11 receives a first gate control signal (GCS1) from the timing controller 30. The first gate driver 11 generates odd-numbered gate signals in accordance with the first gate control signal (GCS1), and supplies the generated odd-numbered gate signals to the odd-numbered gate lines (G1, G3, . . . , Gn−1).

The second gate driver 12 is connected with the even-numbered gate lines (G2, G4, . . . , Gn). The second gate driver 12 receives a second gate control signal (GCS2) from the timing controller 30. The second gate driver 12 generates even-numbered gate signals in accordance with the second gate control signal (GCS2), and supplies the generated even-numbered gate signals to the even-numbered gate lines (G2, G4, . . . , Gn).

As described above, the first and second gate drivers 11 and 12 may be driven in an interlace method, but not limited to this method. The first gate driver 11 may supply the gate signals to some of the gate lines of the display panel 10, and the second gate driver 12 may supply the gate signals to the remaining gate lines of the display panel 10. Also, the first and second gate drivers 11 and 12 may be embodied in one gate driver.

The first and second gate drivers 11 and 12 may be prepared in the non-display area (NDA) by a gate driver in panel (GIP) method. In FIG. 1, the first gate driver 11 is prepared at one side of the non-display area (NDA) of the display panel 10, and the second gate driver 12 is prepared at the other side of the non-display area (NDA) of the display panel 10, but not limited to this structure. For example, both the first and second gate drivers 11 and 12 may be prepared at one side of the non-display area (NDA).

The data driver 20 is connected with the data lines (D1~Dm). The data driver 20 receives digital video data (DATA) and data control signal (DCS) from the timing controller 30, and converts the digital video data (DATA) into analog data voltages in accordance with the data control signal (DCS). The data driver 20 supplies the analog data voltages to the data lines (D1~Dm). The data driver 20 may include a plurality of source driver integrated circuit (hereinafter, referred to as "source driver ICs").

The timing controller 30 receives the digital video data (DATA) and timing signals (TS) from the set. The timing signals may include a vertical sync signal, a horizontal sync signal, a data enable signal, and a dot clock. The timing controller 30 generates the first and second gate control signals (GCS1, GCS2) for controlling the operation timing of the first and second gate drivers 11 and 12 on the basis of the timing signal, and also generates the data control signal (DCS) for controlling the operation timing of the data driver 20 on the basis of the timing signal.

The first gate control signal (GCS1) may include first and second start signals (STV1, STV2), some of clock signals (CLK1, CLK3, CLK5, CLK7), and a first reset signal (RS1). The second gate control signal (GCS2) may include third and fourth start signals (STV3, STV4), the remaining of the clock signals (CLK2, CLK4, CLK6, CLK8), and a second reset signal (RS2).

The timing controller 30 supplies the digital video data (DATA) and the data control signal (DCS) to the data driver 20. The timing controller 30 supplies the first gate control signal (GCS1) to the first gate driver 11, and supplies the second gate control signal (GCS2) to the second gate driver 12.

Figure 4:
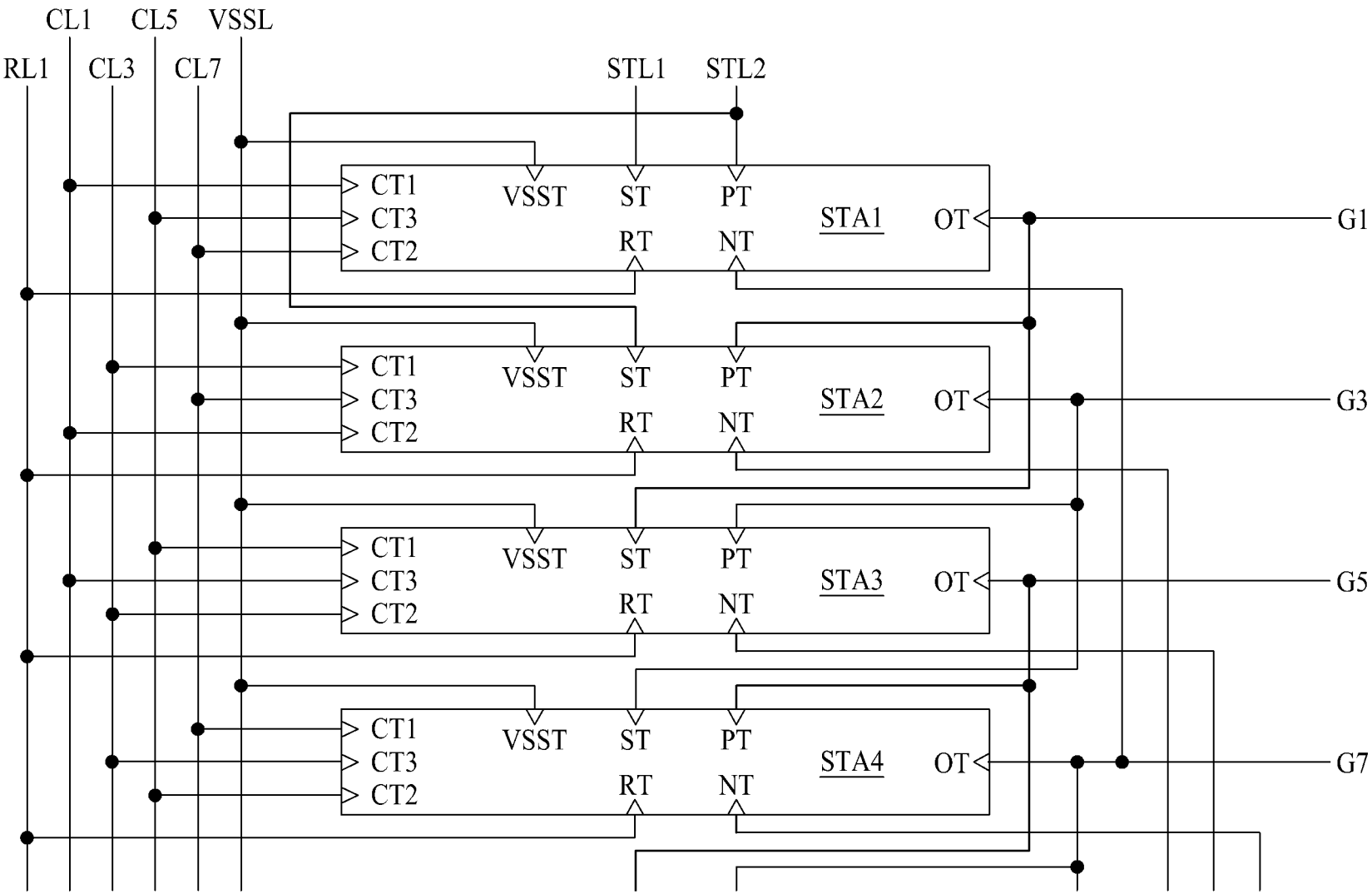
FIG. 4 is a block diagram illustrating one example of a first gate driver according to the present disclosure.

FIG. 4 is a block diagram illustrating one example of the first gate driver according to the present disclosure. In the first gate driver 11, there are a first start signal line (STL1) supplied with the first start signal (STV1), a second start signal line (STL2) supplied with the second start signal (STV2), a first reset line (RL1) supplied with the first reset signal (RS1), first, third, fifth and seventh clock lines (CL1, CL3, CL5, CL7) supplied with the first, third, fifth and seven clock signals (CLK1, CLK3, CLK5, CLK7), and a first power supply voltage line (VSSL) supplied with a first power supply voltage of a DC voltage. The first and second start signals, the first reset signal, and the first, third, fifth and seventh clock signals may be provided from the timing controller 30 of FIG. 1, and the first power supply voltage may be provided from a power supply source.

The first gate driver 11 includes stages (STA1~STAp, p is an integer satisfying '2p=n') connected with the odd-numbered gate lines (G1, G3, . . . , Gn−1). For convenience of explanation, FIG. 4 shows only the first to fourth stages (STA1~STA4) connected with the first, third, fifth and seventh gate lines (G1, G3, G5, G7).

Hereinafter, the front stage (previous stage) indicates the stage positioned prior to the reference stage, and the rear stage (next stage) indicates the stage positioned posterior to the reference stage. For example, the front stages of the third stage (STA3) correspond to the first and second stages (STA1, STA2), and the rear stages of the third stage (STA3) correspond to the fourth to p-th stages (STA4~STAp).

The q-th ('q' is an integer satisfying $1 \leq q \leq p$) stage (STAq) of the first gate driver 11 is connected with the q-th gate line (Gq), to thereby output the gate signal.

Each of the stages (STA1~STAp) includes a start terminal (ST), a reset terminal (RT), a front carry signal input terminal (previous carry signal input terminal, PT), a rear carry signal input terminal (next carry signal input terminal, NT), first to third clock terminals (CT1, CT2, CT3), a first power supply voltage terminal (VSST), and an output terminal (OT).

The start terminal (ST) in each of the stages (STA1~STAp) may be connected with the first start signal line (STL1), the second start signal line (STL2), or the output terminal (OT) of the second front stage, wherein the second front stage indicates the stage positioned in front of the previous stage right ahead of the corresponding stage. That is, the start terminal (ST) of the q-th stage (STAq) may be connected with the first start signal line (STL1), the second start signal line (STL2), or the output terminal (OT) of the (q−2)th stage (STAq−2). In this case, the first start signal of the first start signal line (STL1), the second start signal of the first start signal line (STL1), or the output signal of the output terminal (TO) of the (q−2)th stage (STAq−2) may be inputted to the start terminal (ST) of the q-th stage (STAq). For example, as shown in FIG. 4, in case of the first and second stages (STA1, STA2), the second front stage is not provided, that is, there is no stage positioned in front of the previous stage right ahead of the corresponding stage. Thus, the start terminal (ST) of the first stage (STA1) is connected with the first start signal line (STL1), whereby the first start signal is inputted to the start terminal (ST) of the first stage. Also, the start terminal (ST) of the second stage (STA2) is connected with the second start signal line (STL2), whereby the second start signal is inputted to the start terminal (ST) of the second stage (STA2). Also, as shown in FIG. 4, the start terminal (ST) in each of the third to p-th stages (STA3~STAp) is connected with the output terminal (OT) of the second front stage, whereby the start terminal (ST) in each of the third to p-th stages (STA3~STAp) may be received with the output signal of the output terminal (OT) of the second front stage.

The reset terminal (RT) in each of the stages (STA1~STAp) may be connected with the reset signal line (RL). The reset signal may be inputted to the reset terminal (RT) in each of the stages (STA1~STAp).

The previous output signal input terminal (PT) in each of the stages (STA1~STAp) may be connected with the second start signal line (STL2) or the output terminal (OT) of the first front stage. That is, the previous output signal input terminal (PT) of the q-th stage (STAq) may be connected with the second start signal line (STL2) or the output terminal (OT) of the (q−1)th stage (STAq−1). In this case, the second start signal of the second start signal line (STL2) or the output signal of the output terminal (OT) of the (q−1)th stage (STAq−1) may be inputted to the previous output signal input terminal (PT) of the q-th stage (STAq). For example, as shown in FIG. 4, in case of the first stage, there is no first front stage, that is, there is no stage right ahead of the corresponding stage. Thus, the previous output signal input terminal (TP) of the first stage (STA1) is connected with the second start signal line (STL2) so that the second start signal is inputted to the previous output signal input terminal (TP) of the first stage (STA1). Also, as shown in FIG. 4, the previous output signal input terminal (TP) in each of the second to p-th stages (STA2 STAp) is connected with the output terminal (TP) of the first front stage so that the output signal of the output terminal (OT) of the first front stage is inputted to the previous output signal input terminal (TP) in each of the second to p-th stages (STA2~STAp). With reference to the q-th stage (STAq), the first front stage corresponds to the (q−1)th stage (STAq−1).

The next output signal input terminal (NT) in each of the stages (STA1~STAp) may be connected with the output terminal (OT) of the stage positioned thirdly behind the corresponding stage (hereinafter, referred to as 'third rear stage'). The third rear stage of the q-th stage (STAq) corresponds to the (q+3)th stage (STAq+3). That is, the next output signal input terminal (NT) of the q-th stage (STAq) may be connected with the output terminal (OT) of the (q+3)th stage (STAq+3). In this case, the output signal of the output terminal (OT) of the (q+3)th stage (STAq+3) may be inputted to the next output signal input terminal (NT) of the q-th stage (STAq).

Each of the first to third clock terminals (CT1, CT2, CT3) in each of the stages (STA1~STAp) is connected with any one among the first, third, fifth and seventh clock lines (CL1, CL3, CL5, CL7). Preferably, the clock signals are formed of i-phase clock signals (herein, 'i' is an integer of 4 or more than 4) whose phase is sequentially delayed so as to secure a sufficient charging time for a high-speed driving. Each of the clock signals is cyclically swung between a gate high voltage (VGH) and a gate low voltage (VGL).

Each of the first to third clock terminals (CT1, CT2, CT3) in each of the stages (STA1~STAp) is connected with the corresponding clock line. Thus, the clock signal which is inputted to each of the first to third clock terminals (CT1, CT2, CT3) in each of the stages (STA1~STAp) may be different from each other. For example, as shown in FIG. 4, the first clock terminal (CT1) of the first stage (STA1) is connected with the first clock line (CL1), the second clock terminal (CT2) is connected with the seventh clock line (CL7), and the third clock terminal (CT3) is connected with the fifth clock line (CL5). In this case, the third clock signal (CLK3) is inputted to the first clock terminal (CT1) of the second stage (STA2), the first clock signal (CLK1) is inputted to the second clock terminal (CT2), and the seventh clock signal (CLK7) is inputted to the third clock terminal (CT3).

The odd-numbered clock signals are sequentially supplied to each of the first to third clock terminals (CT1, CT2, CT3) of the stages (STA1~STAp). For example, as shown in FIG. 4, the first clock terminal (CT1) of the first stage (STA1) is connected with the first clock line (CL1) and is received with the first clock signal, the first clock terminal (CT1) of the second stage (STA2) is connected with the third clock line (CL3) and is received with the third clock signal, and the first clock terminal (CT1) of the third stage (STA3) is connected with the fifth clock line (CL5) and is received with the fifth clock signal. Also, as shown in FIG. 4, the second clock terminal (CT2) of the first stage (STA1) is connected with the seventh clock line (CL7) and is received with the seventh clock signal, the second clock terminal (CT2) of the second stage (STA2) is connected with the first clock line (CL1) and is received with the first clock signal, and the second clock terminal (CT2) of the third stage (STA3) is connected with the third clock line (CL3) and is received with the third clock signal. Also, as shown in FIG. 4, the third clock terminal (CT3) of the first stage (STA1) is connected with the fifth clock line (CL5) and is received with the fifth clock signal, the third clock terminal (CT3) of the second stage (STA2) is connected with the seventh clock line (CL7) and is received with the seventh clock signal, and the third clock terminal (CT3) of the third stage (STA3) is connected with the first clock line (CL1) and is received with the first clock signal.

The first power supply voltage terminal (VSST) of each of the stages (STA1~STAp) is connected with the first power supply voltage line (VSSL). Thus, the first power supply voltage is supplied to the first power supply voltage terminal (VSST) of each of the stages (STA1~STAp).

The output terminal (OT) of each of the stages (STA1~STAp) is connected with the gate line. The gate signal is supplied to the output terminal (OT) of each of the stages (STA1~STAp). Also, the output terminal (OT) of each of the stages (STA1~STAp) is connected with the previous output signal input terminal (PT) of the first rear stage, the start terminal (ST) of the second rear stage, and the next output signal input terminal (NT) of the third front stage. With respect to the q-th stage (STAq), the first-next stage corresponds to the (q+1)th stage (STAq+1), the second-next stage corresponds to the (q+2)th stage (STAq+2), and the third front stage corresponds to the (q−3)th stage (STAq−3).

Figure 5:
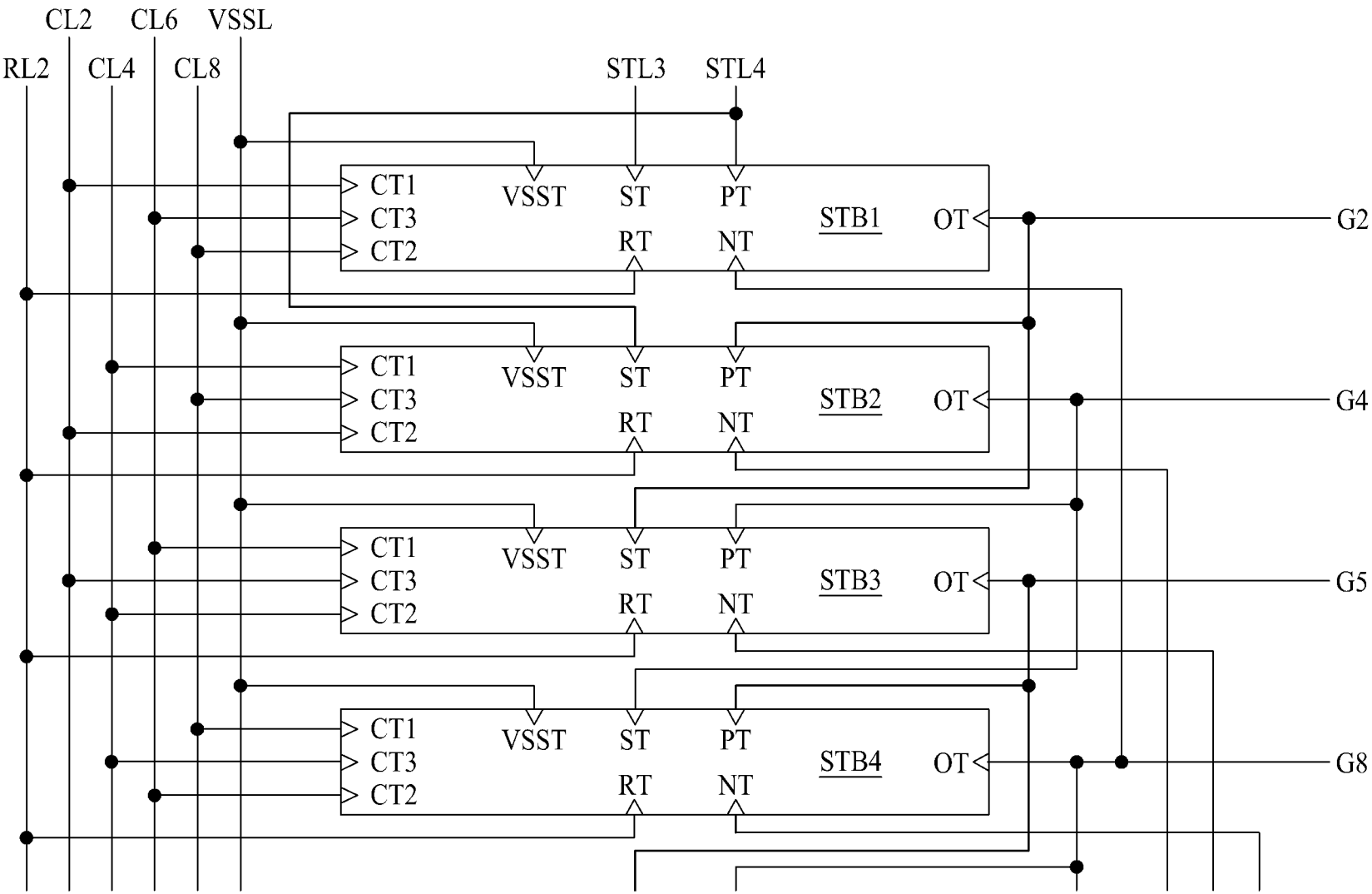
FIG. 5 is a block diagram illustrating one example of a second gate driver according to the present disclosure.

FIG. 5 is a block diagram illustrating one example of the second gate driver according to the present disclosure. In the second gate driver 12, there are a third start signal line (STL3) supplied with a third start signal, a fourth start signal line (STL4) supplied with a fourth start signal, a second reset line (RL2) supplied with the second reset signal (RS2), second, fourth, sixth and eighth clock lines (CL2, CL4, CL6, CL8) supplied with second, fourth, sixth and eighth clock signals, and a first power supply voltage line (VSSL) supplied with a first power supply voltage of a DC voltage. The third and fourth start signals, the second reset signal, the second, fourth, sixth and eighth clock signals may be provided from the timing controller 30 of FIG. 1, and the first power supply voltage may be provided from the power supply source.

The second gate driver 12 includes stages (STB1~STBp) connected with the even-numbered gate lines (G2, G4, . . . , Gn). For convenience of explanation, FIG. 5 shows only the first to fourth stages (STB1~STB4) connected with the second, fourth, sixth and eighth gate lines (G2, G4, G6, G8).

The q-th stage (STBq) of the second gate driver 12 is connected with the 2q-th gate line (G2*q*), to thereby output the gate signal.

Except that each of the stages (STB1~STBp) is connected with the third and fourth start signal lines (STL3, STL4), the second reset line (RL2), and the second, fourth, sixth and eighth clock lines (CL2, CL4, CL6, CL8) instead of the first and second start signal lines (STL1, STL2), the first reset line (RL1), and the first, third, fifth and seventh clock lines (CL1, CL3, CL5, CL7), each of the stages (STB1~STBp) of the second gate driver 12 is the same as each of the stages (STA1~STAp) of the first gate driver 11 shown in FIG. 4. Thus, a detailed description for each of the stages (STB1~STBp) of the second gate driver 12 will be omitted.

Figure 6:
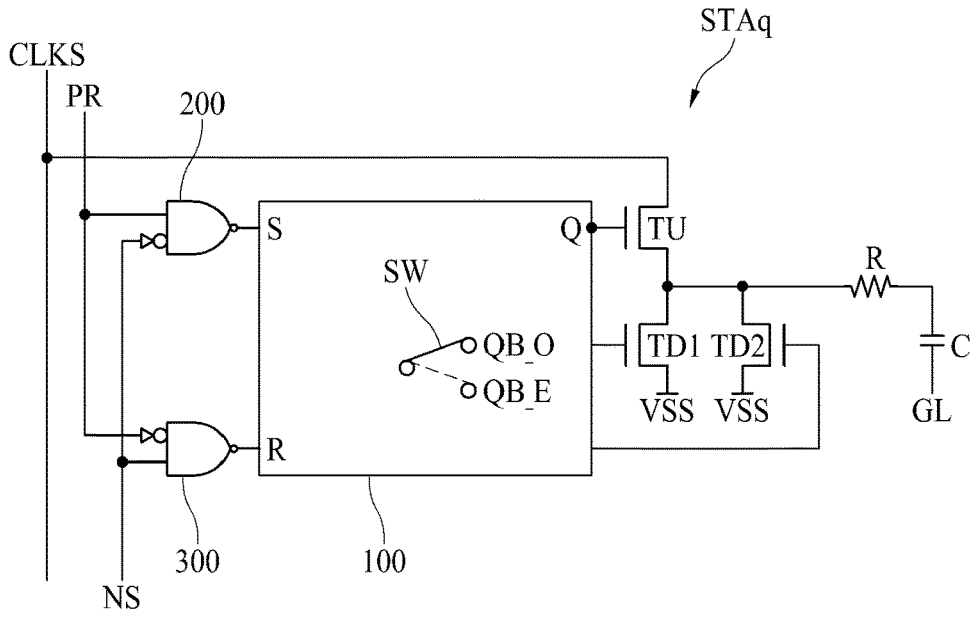
FIG. 6 is a block diagram illustrating the q-th stage according to the present disclosure.

FIG. 6 is a block diagram illustrating the q-th stage according to the present disclosure. The q-th stage (STAq) according to the present disclosure may include a pull-up transistor (TU), first and second pull-down transistors (TD1, TD2), a signal processing portion 100, a first input portion 200, and a second input portion 300.

The pull-up transistor (TU) is turned-on by a gate-on voltage of Q node (NQ), whereby the pull-up transistor (TU) supplies the gate-on voltage supplied through the clock lines (CLKS) to the gate line (GL). The gate line (GL) has resistance and capacitor by a physical property. However, the resistance and capacitor on the gate line (GL) have resistance value and capacitance which have no influence on the supply signal.

The first and second pull-down transistors (TD1, TD2) are turned-on by a gate-on voltage of QB node (NQB), whereby the first and second pull-down transistors (TD1, TD2) supply a gate-off voltage provided from a gate-off voltage line (VSS) to the gate line (GL).

The signal processing portion 100 sets a logic level of Q output terminal (Q) in accordance with a clock signal which is inputted to S input terminal and R input terminal (S, R). The signal processing portion 100 alternately outputs odd-numbered QB node voltage (QB_O) and even-numbered QB node voltage (QB_E) by the use of internal switch (SW). The odd-numbered QB node voltage (QB_O) turns on the first pull-down transistor (TD1), and the even-numbered QB node voltage (QB_E) turns on the second pull-down transistor (TD2).

The first input portion 200 sets a logic level of the S input terminal (S) in accordance with the signal provided from the previous R input terminal (PR) and the next S input terminal (NS).

The second input portion 300 sets a logic level of the R input terminal (R) in accordance with the signal provided from the previous R input terminal (PR) and the next S input terminal (NS).

If the vertical sync signal (Vsync) has a high logic level in 1 frame period, the q-th stage (STAq) maintains the turn-on state of the pull-up transistor (TU).

If the vertical sync signal (Vsync) has a low logic level in 1 frame period, the q-th stage (STAq) maintains the turn-on state of the first and second pull-down transistors (TD1, TD2).

The vertical sync signal (Vsync) corresponds to the signal which reports the start of frame in 1 frame period. Accordingly, the turn-on time of the first and second pull-down transistors (TD1, TD2) is relatively longer than the turn-on time of the pull-up transistor (TU). For example, the turn-on time of the first and second pull-down transistors (TD1, TD2) may be over about 1000 times longer than the turn-on time of the pull-up transistor (TU). In this case, the first and second pull-down transistors (TD1, TD2) deteriorate more rapidly in comparison to the pull-up transistor (TU). Accordingly, the plurality of first and second pull-down transistors (TD1, TD2) are arranged.

The timing controller according to the present disclosure is turned-off until after the preset pull-down transistor among the plurality of pull-down transistors is driven in the gate driver by the use of reset signal supplied from a reset integrated circuit. Accordingly, the driving time period of the first pull-down transistor (TD1) is the same as the driving time period of the second pull-down transistor (TD2). As a result, it is possible to maintain the balance of deterioration between the first pull-down transistor (TD1) and the second pull-down transistor (TD2), to thereby realize a long lifespan of the q-th stage (STAq).

Figure 7:
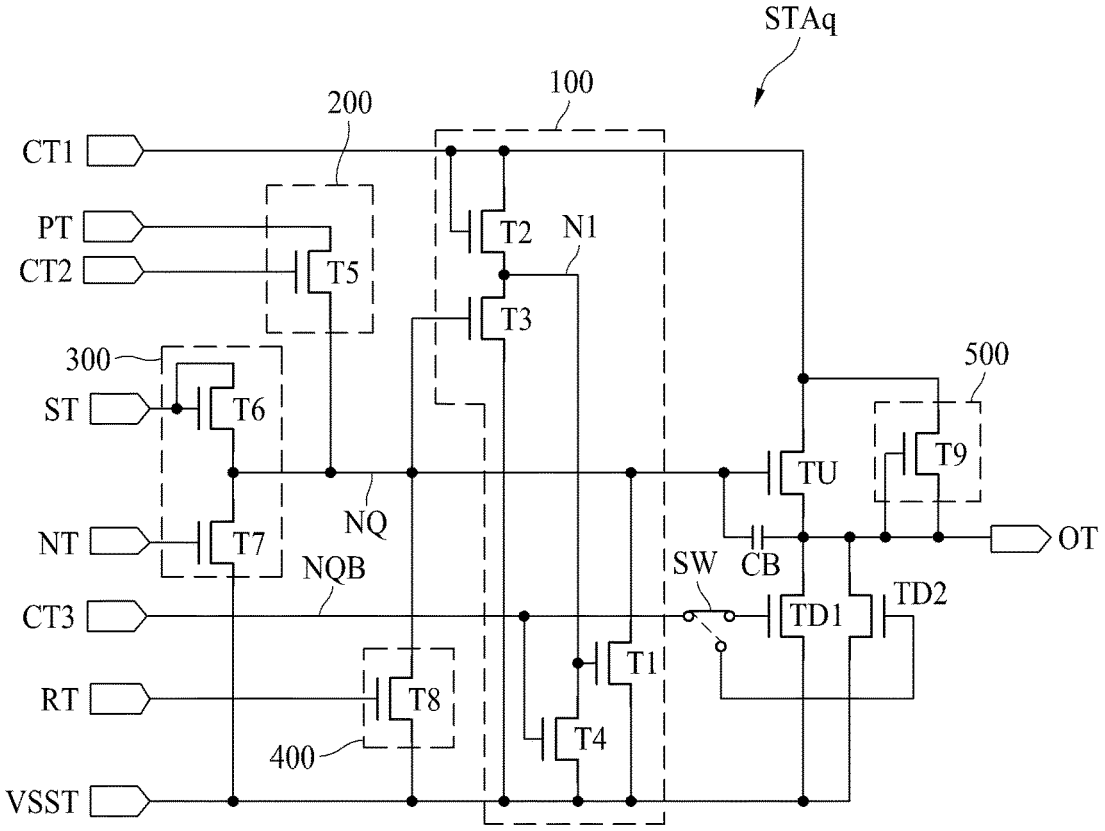
FIG. 7 is a circuit diagram illustrating one example of a stage according to the present disclosure.

FIG. 7 is a circuit diagram illustrating one example of the stage according to the present disclosure. For convenience of explanation, FIG. 7 illustrates a pull-up node corresponding to Q node (NQ), and a pull-down node corresponding to QB node (NQB). The q-th stage (STAq) includes a pull-up transistor (TU), first and second pull-down transistors (TD1, TD2), a signal processing portion 100, a first input portion 200, a second input portion 300, a Q node reset portion 400, an output terminal noise removing portion 500, and a boosting capacitor (CB).

A gate electrode of the pull-up transistor (TU) is connected with the Q node (NQ), a first electrode of the pull-up transistor (TU) is connected with the output terminal (OT), and a second electrode of the pull-up transistor (TU) is connected with the first clock terminal (CT1). If the pull-up transistor (TU) is turned-on by the gate-on voltage of the Q node (NQ), and the clock signal of the gate-on voltage is inputted to the first clock terminal (CT1), the gate signal of the gate-on voltage may be provided to the output terminal (OT).

A gate electrode of the first and second pull-down transistors (TD1, TD2) is connected with the third clock terminal (CT3), a first electrode of the first and second pull-down transistors (TD1, TD2) is connected with the first power supply voltage terminal (VSST), and a second electrode of the first and second pull-down transistors (TD1, TD2) is connected with the output terminal (OT). If the pull-down transistor (TD) is turned-on by the gate-on voltage of the QB node (NQB), the gate signal of the gate-off voltage may be provided to the output terminal (OT).

The switch (SW) connects the gate electrode of the first and second pull-down transistors (TD1, TD2) with the QB node (NQB). The switch (SW) alternately turns on the first pull-down transistor (TD1) and the second pull-down transistor (TD2).

The signal processing portion 100 may include first to fourth transistors (T1, T2, T3, T4).

A gate electrode of the first transistor (T1) is connected with a first node (N1), a first electrode of the first transistor (T1) is connected with the first power supply voltage terminal (VSST), and a second electrode of the first transistor (T1) is connected with the Q node (NQ). According as the first transistor (T1) is turned-on by the gate-on voltage of the first node (N1), the Q node (NQ) is connected with the first power supply voltage terminal (VSST). If the first transistor (T1) is turned-on, the gate-off voltage is supplied to the Q node (NQ), whereby the pull-up transistor (TU) is turned-off.

A gate electrode of the second transistor (T2) is connected with the first clock terminal (CT1), a second electrode of the second transistor (T2) is connected with the first clock terminal (CT1), and a first electrode of the second transistor (T2) is connected with the first node (N1). That is, the second transistor (T2) may be diode-connected. The second transistor (T2) is turned-on by the gate-on voltage of the clock signal which is inputted to the first clock terminal (CT1), whereby the gate-on voltage is supplied to the first node (N1). If the second transistor (T2) is turned-on, the gate-on voltage is supplied to the first node (N1), whereby the first transistor (T1) is turned-on.

A gate electrode of the third transistor (T3) is connected with the Q node (NQ), a first electrode of the third transistor (T3) is connected with the first power supply voltage terminal (VSST), and a second electrode of the third transistor (T3) is connected with the first node (N1). The third transistor (T3) is turned-on by the gate-on voltage of the Q node (NQ), whereby the first node (N1) is connected with the first power supply voltage terminal (VSST). If the third transistor (T3) is turned-on, the gate-off voltage is supplied to the first node (N1), whereby the first transistor (T1) is turned-off.

A gate electrode of the fourth transistor (T4) is connected with the QB node (NQB), a first electrode of the fourth transistor (T4) is connected with the first power supply voltage terminal (VSST), and a second electrode of the fourth transistor (T4) is connected with the first node (N1). The fourth transistor (T4) is turned-on by the gate-on voltage of the QB node (NQB), whereby the first node (N1) is connected with the first power supply voltage terminal (VSST). If the fourth transistor (T4) is turned-on, the gate-off voltage is supplied to the first node (N1), whereby the first transistor (T1) is turned-off.

The first input portion 200 may include a fifth transistor (T5).

A gate electrode of the fifth transistor (T5) is connected with the second clock terminal (CT2), a first electrode of the fifth transistor (T5) is connected with the Q node (NQ), and a second electrode of the fifth transistor (T5) is connected with the previous output signal input terminal (PT). The fifth transistor (T5) is turned-on by the gate-on voltage of the clock signal which is inputted to the second clock terminal (CT2), whereby the Q node (NQ) is connected with the previous output signal input terminal (PT). If the fifth transistor (T5) is turned-on, the gate-on voltage or gate-off voltage of the output signal of the (q−1)th stage (STAq−1) which is provided from the previous output signal input terminal (PT) may be supplied to the Q node (NQ).

The second input portion 300 may include sixth and seventh transistors.

A gate electrode of the sixth transistor (T6) is connected with the start terminal (ST), a second electrode of the sixth transistor (T6) is connected with the start terminal (ST), and a first electrode of the sixth transistor (T6) is connected with the Q node (NQ). That is, the sixth transistor (T6) may be diode-connected. The sixth transistor (T6) is turned-on by the first start signal which is inputted to the start terminal (ST), the second start signal which is inputted to the start terminal (ST), or the gate-on voltage of the output signal of the (q−2)th stage (STAq−2). If the sixth transistor (T6) is turned-on, the gate-on voltage is supplied to the Q node (NQ), whereby the pull-up transistor (TU) is turned-on.

A gate electrode of the seventh transistor (T7) is connected with the next output signal input terminal (NT), a first electrode of the seventh transistor (T7) is connected with the first power supply voltage terminal (VSST), and a second electrode of the seventh transistor (T7) is connected with the Q node (NQ). The seventh transistor (T7) is turned-on by the gate-on voltage of the output signal of the (q+3)th stage (STAq+3) which is inputted to the next output signal input terminal (NT), whereby the gate-off voltage is supplied to the Q node (NQ). If the seventh transistor (T7) is turned-on, the gate-off voltage is supplied to the Q node (NQ), whereby the pull-up transistor (TU) is turned-off.

The Q node reset portion 400 sets the Q node (NQ) in accordance with the first reset signal provided to the reset terminal (RT), whereby the Q node (NQ) is reset to the gate-off voltage. The Q node reset portion 400 may include an eighth transistor (T8).

A gate electrode of the eighth transistor (T8) is connected with the reset terminal (RT), a first electrode of the eighth transistor (T8) is connected with the first power supply voltage terminal (VSST), and a second electrode of the eighth transistor (T8) is connected with the Q node (NQ). The eighth transistor (T8) connects the Q node (NQ) with the first power supply voltage terminal (VSST) in accordance with the gate-on voltage of the first reset signal which is inputted to the reset terminal (RT). If the eighth transistor (T8) is turned-on, the Q node (NQ) is reset to the gate-off voltage.

The output terminal noise removing portion 500 connects the output terminal (OT) with the first clock terminal (CT1) in accordance with the voltage of the output terminal (OT), to thereby remove noise from the output terminal (OT). The output terminal noise removing portion 500 may include a ninth transistor (T9).

A gate electrode of the ninth transistor (T9) is connected with the output terminal (OT), a first electrode of the ninth transistor (T9) is connected with the output terminal (OT), and a second electrode of the ninth transistor (T9) is connected with the first clock terminal (CT1). That is, the ninth transistor (T9) may be diode-connected. If the voltage of the output terminal (OT) is higher than a total value obtained by adding the voltage of the clock signal which is inputted to the first clock terminal (CT1) and a threshold voltage of the ninth transistor (T9), the ninth transistor (T9) connects the output terminal (OT) with the first clock terminal (CT1). Accordingly, if noise is generated in the output terminal (OT), and the voltage of the output terminal (OT) is higher than the total value obtained by adding the gate-off voltage of the clock signal which is inputted to the first clock terminal (CT1) and the threshold voltage of the ninth transistor (T9), the noise of the output terminal (OT) may be discharged to the first clock terminal (OT).

The boosting capacitor (CB) is connected between the output terminal (OT) and the Q node (NQ). The boosting capacitor (CB) maintains a differential voltage between the output terminal (OT) and the Q node (NQ).

The first electrode in each of the pull-up transistor (TU), the pull-down transistor (TD), and the first to ninth transistors (T1~T9) may be a source electrode, and the second electrode in each of the pull-up transistor (TU), the pull-down transistor (TD), and the first to ninth transistors (T1~T9) may be a drain electrode, but not necessarily. That is, the first electrode in each of the pull-up transistor (TU), the pull-down transistor (TD), and the first to ninth transistors (T1~T9) may be the drain electrode, and the second electrode in each of the pull-up transistor (TU), the pull-down transistor (TD), and the first to ninth transistors (T1~T9) may be the source electrode.

Meanwhile, for convenience of explanation, FIG. 7 shows only the q-th stage (STAq). Each of the stages (STA1~STAp) of the first gate driver 11 and each of the stages (STB1~STBp) of the second gate driver 12 may be the same as the q-th stage (STAq) shown in FIG. 7.

Figure 8:
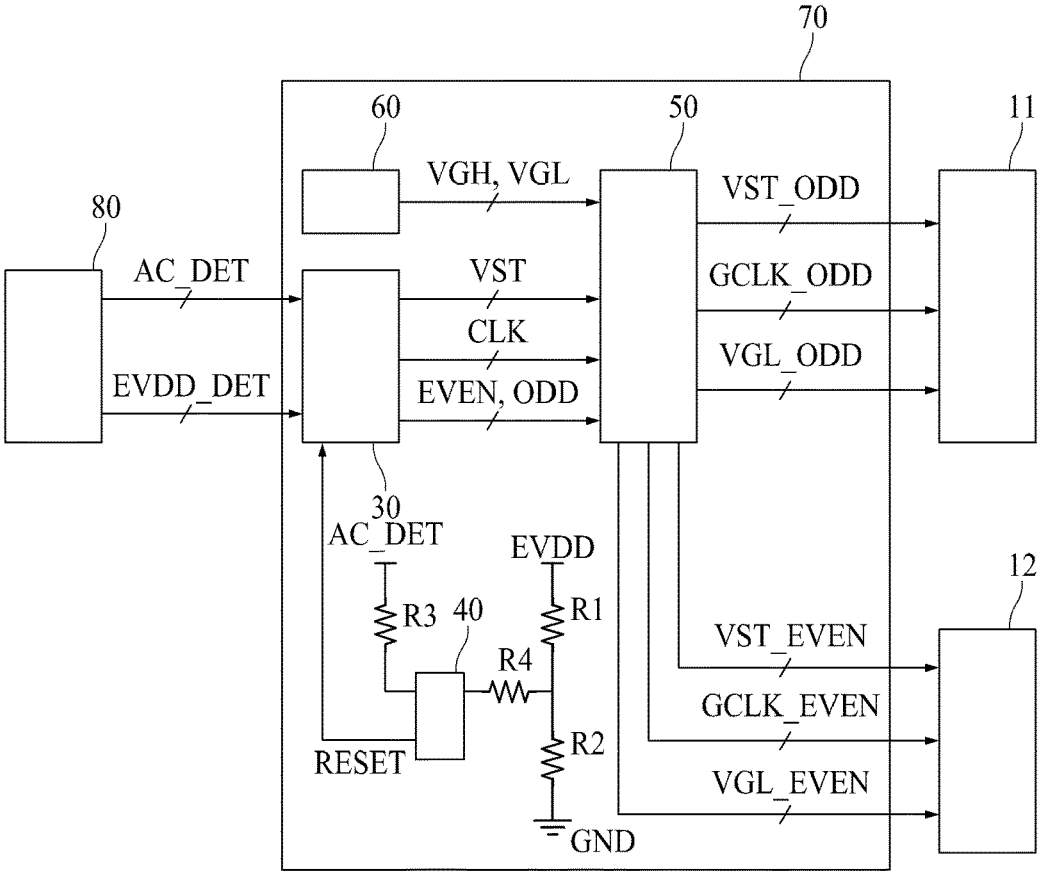
FIG. 8 is a block diagram illustrating a control printed circuit board, a set, and first and second gate drivers according to the present disclosure.

FIG. 8 is a block diagram illustrating a control printed circuit board, a set, and first and second gate drivers according to the present disclosure.

The control printed circuit board 70 drives and controls the display device. The control printed circuit board 70 may include a timing controller 30, a reset integrated circuit 40, a first signal correcting portion 50, and a power supply generating circuit 60.

The set 80 supplies power supply voltages and driving signals to the control printed circuit board 70. A host system for providing information so as to drive and control the display device may be provided in the set 80. The set 80 may be embodied in a set-top box, a phone system, a personal computer (PC), a broadcasting receiver, a navigation system, a DVD player, a blue-ray player, and a home theater system.

The timing controller 30 receives an off-notification signal (AC_DET) and a power supply voltage notification signal (EVDD_DET) from the set 80. The off-notification signal is provided to notify the turn-off state of the set 80 to the timing controller 30. The power supply voltage notification signal (EVDD_DET) is provided to monitor a power supply voltage (EVDD). If the power supply voltage (EVDD) is lowered below a predetermined voltage value, that is, it enters a low state, the power supply voltage notification signal (EVDD_DET) enters an off-sequence stage corresponding to a driving mode in which the timing controller 30 is changed to a turn-off state.

The reset integrated circuit 40 receives the off-notification signal (AC_DET) and the power supply voltage notification signal (EVDD_DET). If the power supply voltage (EVDD) is lowered below the predetermined voltage value in accordance with a ratio of a first resistance (R1) and a second resistance (R2), or the off-notification signal (AC_DET) has the low logic level, the reset integrated circuit 40 generates the reset signal (RESET). The reset integrated circuit 40 transmits the reset signal (RESET) to the timing controller 30, whereby the timing controller 30 enters a reset mode. A third resistance (R3) may be formed between the reset integrated circuit 40 and the timing controller 30, and a fourth resistance (R4) is formed between the reset integrated circuit 40 and the power supply voltage (EVDD) line. The supply of the reset signal (RESET) is not influenced by the third resistance and the fourth resistance.

The first signal correcting portion 50 receives the plurality of start signals (VST), the plurality of clock signals (CLK), a plurality of even-numbered notification signals (EVEN), and a plurality of odd-numbered notification signals (ODD) from the timing controller 30. The first signal correcting portion 50 receives the gate-on voltage (VGH) and the gate-off voltage (VGL) from the power supply generating circuit 60.

The first signal correcting portion 50 generates a plurality of even-numbered start signals (VST_EVEN), a plurality of even-numbered gate clock signals (GCLK_EVEN), and a plurality of even-numbered gate-off voltages (VGL_EVEN) by the use of the plurality of even-numbered notification signals (EVEN). The first signal correcting portion 50 supplies the plurality of even-numbered start signals (VST_EVEN), the plurality of even-numbered gate clock signals (GCLK_EVEN), and the plurality of even-numbered gate-off voltages (VGL_EVEN) to the second gate driver 12.

The first signal correcting portion 50 generates a plurality of odd-numbered start signals (VST_ODD), a plurality of odd-numbered gate clock signals (GCLK_ODD), and a plurality of odd-numbered gate-off voltages (VGL_ODD) by the use of the plurality of odd-numbered notification signals (ODD). The first signal correcting portion 50 supplies the plurality of odd-numbered start signals (VST_ODD), the plurality of odd-numbered gate clock signals (GCLK_ODD), and the plurality of odd-numbered gate-off voltages (VGL_ODD) to the first gate driver 11.

The power supply generating circuit 60 generates the gate-on voltage (VGH) and the gate-off voltage (VGL). The power supply generating circuit 60 transmits the gate-on voltage (VGH) and the gate-off voltage (VGL) to the first signal correcting portion 50. The power supply generating circuit 60 is provided inside the first signal correcting portion 50.

Figure 9:
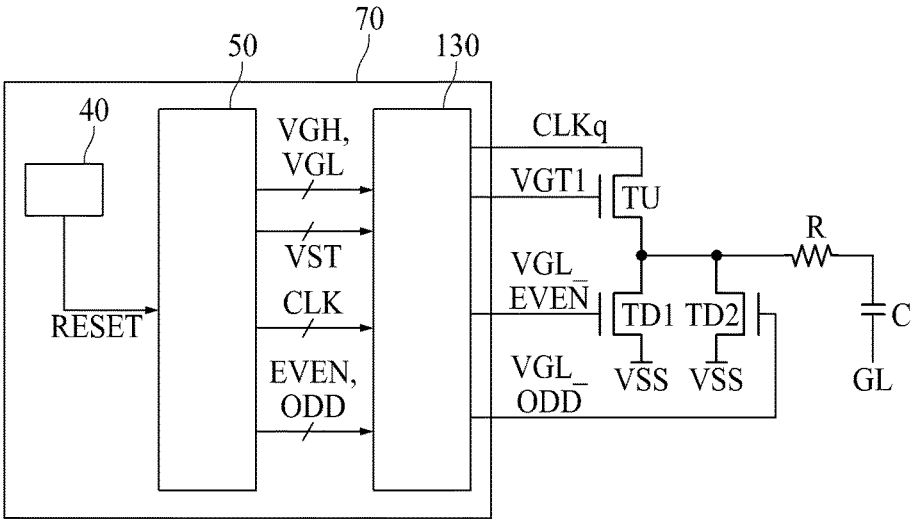
FIG. 9 is a block diagram illustrating a control printed circuit board, a pull-up transistor, a first pull-down transistor, and a second pull-down transistor according to the first embodiment of the present disclosure.
Figure 10:
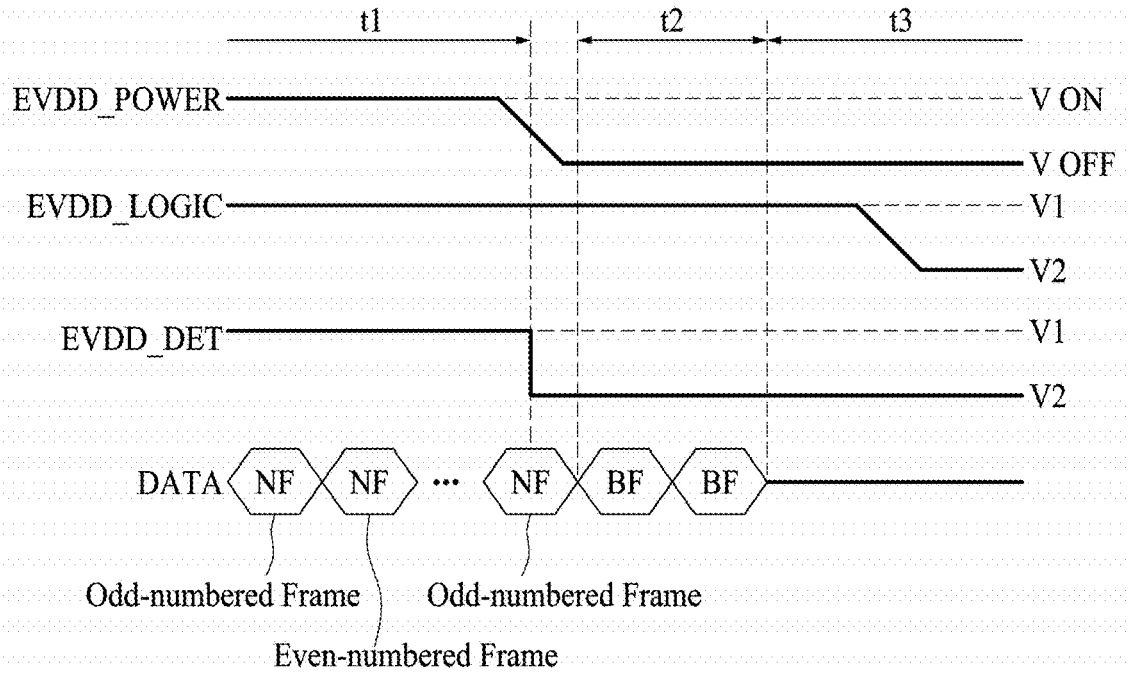
FIG. 10 is a waveform diagram illustrating a virtual power supply voltage, a logic power supply voltage, a sensing power supply voltage, and digital video data according to the present disclosure.

FIG. 9 is a block diagram illustrating a control printed circuit board, a pull-up transistor, a first pull-down transistor, and a second pull-down transistor according to the first embodiment of the present disclosure. FIG. 10 is a waveform diagram illustrating a virtual power supply voltage (EVDD_POWER), a logic power supply voltage (EVDD_LOGIC), a sensing power supply voltage (EVDD_DET), and digital video data (DATA) according to the present disclosure.

The control printed circuit board 70 according to the first embodiment of the present disclosure includes a reset integrated circuit 40, a first signal correcting portion 50, and a second signal correcting portion 130.

The reset integrated circuit 40 supplies the reset signal (RESET) to the first signal correcting portion 50.

The timing controller 30 and the power supply generating circuit 60 are provided in the first signal correcting portion 50. The reset signal (RESET) is supplied to the first signal correcting portion 50. The first signal correcting portion 50 generates the gate-on voltage (VGH), the gate-off voltage (VGL), the plurality of start signals (VST), the plurality of clock signals (CLK), the plurality of even-numbered notification signals (EVEN), and the plurality of odd-numbered notification signals (ODD).

The first signal correcting portion 50 supplies the gate-on voltage (VGH), the gate-off voltage (VGL), the plurality of start signals (VST), the plurality of clock signals (CLK), the plurality of even-numbered notification signals (EVEN), and the plurality of odd-numbered notification signals (ODD) to the second signal correcting portion 130.

The second signal correcting portion 130 is supplied with the gate-on voltage (VGH), the gate-off voltage (VGL), the plurality of start signals (VST), the plurality of clock signals (CLK), the plurality of even-numbered notification signals (EVEN), and the plurality of odd-numbered notification signals (ODD) from the first signal correcting portion 50. The second signal correcting portion 130 generates a first gate turn-on voltage (VGT1) corresponding to the gate-on voltage, the q-th clock signal (CLKq), an even-numbered gate low voltage (VGL_EVEN), and an odd-numbered gate low voltage (VGL_ODD) on the basis of the plurality of even-numbered notification signals (EVEN) and the plurality of odd-numbered notification signals (ODD).

The second signal correcting portion 130 supplies the first gate turn-on voltage (VGT1) to the gate electrode of the pull-up transistor (TU). The first signal correcting portion 50 supplies the q-th clock signal (CLKq) to the first electrode of the pull-up transistor (TU).

The second signal correcting portion 130 supplies the even-numbered gate low voltage (VGL_EVEN) to the gate electrode of the first pull-down transistor (TD1). The first signal correcting portion 50 supplies the odd-numbered gate low voltage (VGL_ODD) to the gate electrode of the second pull-down transistor (TD2).

The second signal correcting portion 130 supplies a normal frame (NF) for a first time period (T1) wherein the display device is in the turn-on state, and the virtual power supply voltage (EVDD_POWER) is maintained in the on-voltage state (V ON).

If the display device is changed from the turn-on state to the turn-off state, and the virtual power supply voltage (EVDD_POWER) is changed from the on-voltage state (V ON) to the off-voltage (V OFF) state, the reset integrated circuit 40 generates the reset signal (RESET), and supplies the generated reset signal (RESET) to the first signal correcting portion 50. If the reset signal (RESET) is supplied to the first signal correcting portion 50, a second time period (T2) is started. When the first time period (T1) is changed into the second time period (T2), the power supply voltage notification signal (EVDD_DET) enters a low state, and the first signal correcting portion 50 enters an off-sequence stage.

If the reset signal (RESET) is supplied to the first signal correcting portion 50, under control of the second signal correcting portion 130, the even-numbered gate low voltage (VGL_EVEN) is finally outputted from the data driver 20, and then the digital video data is not outputted from the data driver 20. From a time point at which the digital video data (DATA) is not outputted, the second signal correcting portion 130 does not output the odd-numbered gate low voltage (VGL_ODD), the q-th clock signal (CLKq), and the first gate turn-on voltage (VGT1) supplied to the pull-up transistor (TU) and the second pull-down transistor (TD2).

The driving timing in the first and second signal correcting portions 50 and 130 of the display device according to the first embodiment of the present disclosure is set in such a way that the second pull-down transistor (TD2) is finally driven. The display device according to the first embodiment of the present disclosure is set in such a way that the display device is turned-off until after the even-numbered frame is finally driven by the use of reset signal (RESET). The first and second pull-down transistors (TD1, TD2) are alternately driven every frame. In this reason, the display device according to the first embodiment of the present disclosure is set in such a way that the display device is driven until the even-numbered frame is finally driven by the use of reset signal (RESET), whereby the second pull-down transistor (TD2) is finally driven.

The reset signal (RESET) is generated in the reset integrated circuit 40, and the reset signal (RESET) is supplied to the timing controller 30 provided inside the first signal correcting portion 50. If the reset signal (RESET) is supplied to the first signal correcting portion 50, the data driver 20 is maintained in the turn-on state under control of the second signal correcting portion 130. The data driver 20 maintains the floating state of the data lines (D1~Dm) so as to prevent a predetermined frame from being inserted until the second pull-down transistor (TD2) is driven finally, or so as to prevent a meaningful image from being displayed until the second pull-down transistor (TD2) is driven finally.

For example, if the reset signal (RESET) is supplied to the first signal correcting portion 50, the second signal correcting portion 130 controls the data driver 20 so as to insert a black frame (BF). The insertion of the black frame (BF) indicates displaying a black image on the display area (DA) of the display panel 10 for one frame period. That is, the data driver 20 applies the data voltage corresponding to the black image to the display panel 10, whereby the black image is displayed on the display panel 10 for one frame period.

Under control of the second signal correcting portion 130, the black frame (BF) is capable of being inserted until the time point of finally driving the second pull-down transistor (TD2). If the finally-output frame corresponds to the odd-numbered frame, the second signal correcting portion 130 adds one black frame (BF). If the finally-output frame corresponds to the even-numbered frame, under control of the second signal correcting portion 130, the digital video data (DATA) is not outputted without insertion of the black frame (BF).

In the display device according to the first embodiment of the present disclosure, the transistor finally used for the previous driving is set to the second transistor (TD2). Thus, even though the first transistor (TD1) is firstly driven for the next driving, it is possible to maintain the deterioration balance between the first pull-down transistor (TD1) and the second pull-down transistor (TD2). According as the deterioration balance is maintained between the first pull-down transistor (TD1) and the second pull-down transistor (TD2), it is possible to increase a lifespan of the display device.

Figure 11:
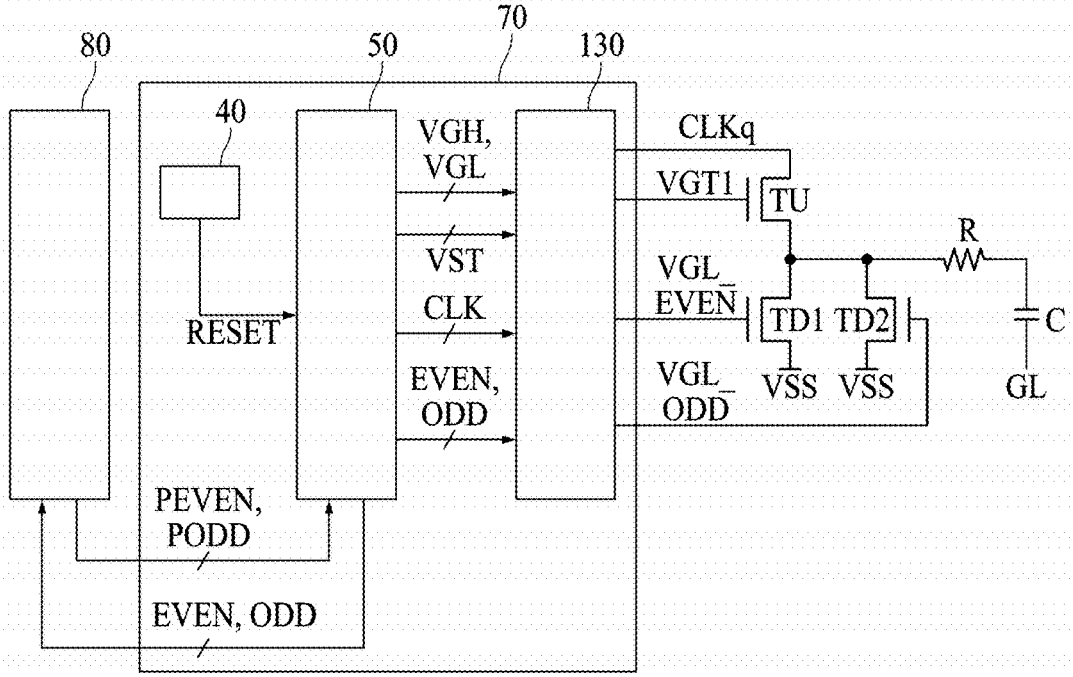
FIG. 11 is a block diagram illustrating a control printed circuit board, a pull-up transistor, a first pull-down transistor, and a second pull-down transistor according to the second embodiment of the present disclosure.

FIG. 11 is a block diagram illustrating a control printed circuit board 70, a pull-up transistor (TD), a first pull-down transistor (TD1), and a second pull-down transistor (TD2) according to the second embodiment of the present disclosure.

Unlike the display device according to the first embodiment of the present disclosure, the display device according to the second embodiment of the present disclosure is not set in such a way that the second pull-down transistor (TD2) is driven finally. When the display panel 10 is turned-on, the pull-down transistor which is not used finally for the previous driving is turned-on firstly.

The display device according to the second embodiment of the present disclosure needs information about the finally-driven transistor in the first and second pull-down transistors (TD1, TD2). To this end, if the reset signal (RESET) is supplied to the first signal correcting portion 50 of the display device according to the second embodiment of the present disclosure, the first signal correcting portion 50 detects that the finally-output frame at the final time point corresponds to the odd-numbered frame or the even-numbered frame. For the detection of the finally-output frame at the final time point, it is possible to generate information about which of the first and second pull-down transistors (TD1, TD2) is finally driven at the final time point.

The information about which of the first and second pull-down transistors (TD1, TD2) is finally driven at the final time point is stored when the display panel 10 is turned-off. For example, as shown in FIG. 11, the information about which of the first and second pull-down transistors (TD1, TD2) is finally driven at the final time point is stored in the set 80 at the time point when the display device enters the off-sequence stage, and the information about which of the first and second pull-down transistors (TD1, TD2) is finally driven at the final time point is loaded from the set 80 when the display device is turned-on, but not limited to this structure. For example, the information about which of the first and second pull-down transistors (TD1, TD2) is finally driven at the final time point may be stored in the internal memory of the first signal correcting portion 50 shown in FIG. 9.

In order to generate the information about which of the first and second pull-down transistors (TD1, TD2) is finally driven at the final time point, the first signal correcting portion 50 detects that the number of driven frames, that is, the number of frames which are outputted for the turn-on time period corresponds to the odd number or even number. To this end, the first signal correcting portion 50 uses an internal counter so as to count the number of driven frames.

According to the second embodiment of the present disclosure, if the information about which of the first and second pull-down transistors (TD1, TD2) is finally driven at the final time point is stored in the set 80, as shown in FIG. 11, the first signal correcting portion 50 supplies the plurality of even-numbered notification signals (EVEN) and the plurality of odd-numbered notification signals (ODD), which are generated in the first signal correcting portion 50, to the set 80 at the time point when the reset signal (RESET) is supplied to the first signal correcting portion 50. According to the second embodiment of the present disclosure, if the information about which of the first and second pull-down transistors (TD1, TD2) is finally driven at the final time point is stored in the first signal correcting portion 50, the first signal correcting portion 50 generates the information about which of the first and second pull-down transistors (TD1, TD2) is finally driven at the final time point by the use of the plurality of even-numbered notification signals (EVEN) and the plurality of odd-numbered notification signals (ODD), which are generated in the first signal correcting portion 50 and are generated at the time point when the reset signal (RESET) is supplied to the first signal correcting portion 50, and then stores the generated information in the internal memory.

If the information about which of the first and second pull-down transistors (TD1, TD2) is finally driven at the final time point is stored in the set 80, the first signal correcting portion 50 transmits the plurality of even-numbered notification signals (EVEN) and the plurality of odd-numbered notification signals (ODD) to the set 80 through the use of I2C interface corresponding to an interface which transmits information to the set 80 and receives information from the set 80. The set 80 stores frame order information stored in the plurality of even-numbered notification signals (EVEN) and the plurality of odd-numbered notification signals (ODD).

If turning-on the display device after the turn-off state, the set 80 supplies the stored previous even-numbered notification signal (PEVEN) and previous odd-numbered notification signal (PODD) to the first signal correcting portion 50. Accordingly, the set 80 detects that the voltage finally supplied from the first and second pull-down transistors (TD1, TD2) corresponds to the even-numbered gate low voltage (VGL_EVEN) or the odd-numbered gate low voltage (VGL_ODD).

If it is turned-off under the circumstance that the even-numbered gate low voltage (VGL_EVEN) is finally supplied thereto, the display device is turned-off until after the second pull-down transistor (TD2) is finally used. Meanwhile, if it is turned-off under the circumstance that the odd-numbered gate low voltage (VGL_ODD) is finally supplied thereto, the display device is turned-off until after the first pull-down transistor (TD1) is finally used.

Based on the detection result, the first signal correcting portion 50 starts to drive the pull-down transistor which is not used finally for the previous driving.

If it is turned-off under the circumstance that the even-numbered gate low voltage (VGL_EVEN) is finally supplied thereto, the display device is turned-off until after the first pull-down transistor (TD1) is finally used. In this case, the second pull-down transistor (TD2) is firstly turned-on and driven. Meanwhile, if it is turned-off under the circumstance that the odd-numbered gate low voltage (VGL_ODD) is finally supplied thereto, the display device is turned-off until after the second pull-down transistor (TD2) is finally used. In this case, the first pull-down transistor (TD1) is firstly turned-on and driven.

According as the transistor which is not finally used for the previous driving is firstly used for the next driving in the display device according to the second embodiment of the present disclosure, it is possible to maintain the deterioration balance between the first pull-down transistor (TD1) and the second pull-down transistor (TD2). According as the deterioration balance is maintained between the first pull-down transistor (TD1) and the second pull-down transistor (TD2), it is possible to increase a lifespan of the display device.

Figure 12:
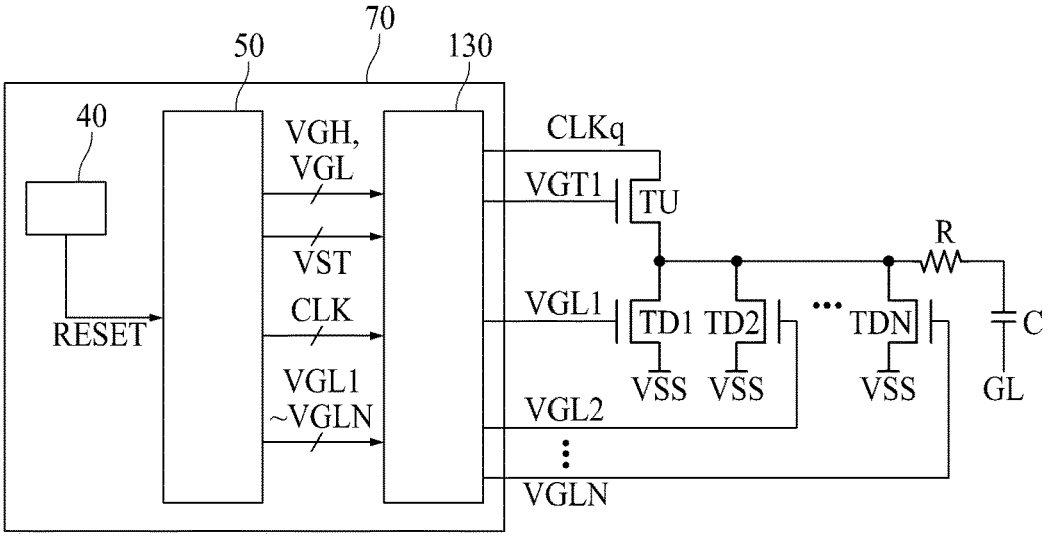
FIG. 12 is a block diagram illustrating a control printed circuit board, a pull-up transistor, and first to N-th pull-down transistors (herein, 'N' is an integer of 3 or more than 3) according to the third embodiment of the present disclosure.

FIG. 12 is a block diagram illustrating a control printed circuit board 70, a pull-up transistor (TU), and first to N-th pull-down transistors (TD1~TDN, herein, 'N' is an integer of 3 or more than 3).

The reset integrated circuit 40 supplies the reset signal (RESET) to the first signal correcting portion 50.

The timing controller 30 and the power supply generating circuit 60 are provided inside the first signal correcting portion 50. The reset signal (RESET) is supplied to the first signal correcting portion 50. The first signal correcting portion 50 generates the gate-on voltage (VGH), the gate-off voltage (VGL), the plurality of start signals (VST), the plurality of clock signals (CLK), and first to N-th gate low voltages (VGL1~VGLN).

The first signal correcting portion 50 supplies the gate-on voltage (VGH), the gate-off voltage (VGL), the plurality of start signals (VST), the plurality of clock signals (CLK), and the first to N-th gate low voltages (VGL1~VGLN) to the second signal correcting portion 130.

The second signal correcting portion 130 is supplied with the gate-on voltage (VGH), the gate-off voltage (VGL), the plurality of start signals (VST), the plurality of clock signals (CLK), the plurality of even-numbered notification signals (EVEN), and the plurality of odd-numbered notification signals (ODD) from the first signal correcting portion 50. The second signal correcting portion 130 generates the first gate turn-on voltage (VGT1) corresponding to the gate-on voltage, the q-th clock signal (CLKq), and the first to N-th gate low voltages (VGL1~VGLN) on the basis of the plurality of even-numbered notification signals (EVEN) and the plurality of odd-numbered notification signals (ODD).

The second signal correcting portion 130 supplies the first gate turn-on voltage (VGT1) to the gate electrode of the pull-up transistor (TU). The first signal correcting portion 50 supplies the q-th clock signal (CLKq) to the first electrode of the pull-up transistor (TU).

The second signal correcting portion 130 supplies the first to N-th gate low voltages (VGL1~VGLN) to the gate electrodes of the first to N-th pull-down transistors (TD1~TDN).

The second signal correcting portion 130 supplies the normal frame (NF) for the first time period (T1) wherein the display device is in the turn-on state, and the virtual power supply voltage (EVDD_POWER) is maintained in the on-voltage state (V ON).

If the display device is changed from the turn-on state to the turn-off state, and the virtual power supply voltage (EVDD_POWER) is changed from the on-voltage state (V ON) to the off-voltage (V OFF) state, the reset integrated circuit 40 generates the reset signal (RESET), and supplies the generated reset signal (RESET) to the first signal correcting portion 50. If the reset signal (RESET) is supplied to the first signal correcting portion 50, the second time period (T2) is started. When the first time period (T1) is changed into the second time period (T2), the power supply voltage notification signal (EVDD_DET) enters the low state, and the first signal correcting portion 50 enters the off-sequence stage.

If the reset signal (RESET) is supplied to the first signal correcting portion 50, under control of the second signal correcting portion 130, the N-th gate low voltage (VGLN) is finally outputted from the data driver 20, and then the digital video data (DATA) is not outputted from the data driver 20. From a time point at which the digital video data (DATA) is not outputted, the second signal correcting portion 130 does not output the N gate low voltages (VGL1~VGLN), the q-th clock signal (CLKq), and the first gate turn-on voltage (VGT1) supplied to the pull-up transistor (TU) and the second pull-down transistor (TD2).

The driving timing in the first and second signal correcting portions 50 and 130 of the display device according to the third embodiment of the present disclosure is set in such a way that the N-th pull-down transistor (TDN) is finally driven. The display device according to the third embodiment of the present disclosure is set in such a way that the display device is turned-off until after the N multiple numbered frame is finally driven by the use of reset signal (RESET). The first to N-th pull-down transistors (TD1~TDN) are sequentially driven every frame. In this reason, the display device according to the third embodiment of the present disclosure is set in such a way that the display device is driven until the N multiple numbered frame is finally driven by the use of reset signal (RESET), whereby the N-th pull-down transistor (TDN) is finally driven.

The reset signal (RESET) is generated in the reset integrated circuit 40, and the reset signal (RESET) is supplied to the timing controller 30 provided inside the first signal correcting portion 50. If the reset signal (RESET) is supplied to the first signal correcting portion 50, the data driver 20 is maintained in the turn-on state under control of the second signal correcting portion 130. The data driver 20 maintains the floating state of the data lines (D1~Dm) so as to prevent the predetermined frame from being inserted until the N-th pull-down transistor (TDN) is driven finally, or so as to prevent the meaningful image from being displayed until the N-th pull-down transistor (TDN) is driven finally.

For example, if the reset signal (RESET) is supplied to the first signal correcting portion 50, the second signal correcting portion 130 controls the data driver 20 so as to insert the black frame (BF). Under control of the second signal correcting portion 130, the black frame (BF) is capable of being inserted until the time point of finally driving the N-th pull-down transistor (TDN). If the finally-output frame is not the N multiple numbered frame, the second signal correcting portion 130 adds 1 to (N−1) numbered black frames (BF) until it becomes the N-multiple numbered frame. If the finally-output frame corresponds to the N multiple numbered frame, the black frame (BF) is not inserted.

In the display device according to the third embodiment of the present disclosure, the transistor finally used for the previous driving is set to the N-th transistor (TDN). Thus, even though the first transistor (TD1) is firstly driven for the next driving, it is possible to maintain the deterioration balance among the first to N-th pull-down transistors (TD1~TDN). According as the deterioration balance is maintained among the first to N-th pull-down transistors (TD1~TDN), it is possible to increase a lifespan of the display device.

Figure 13:
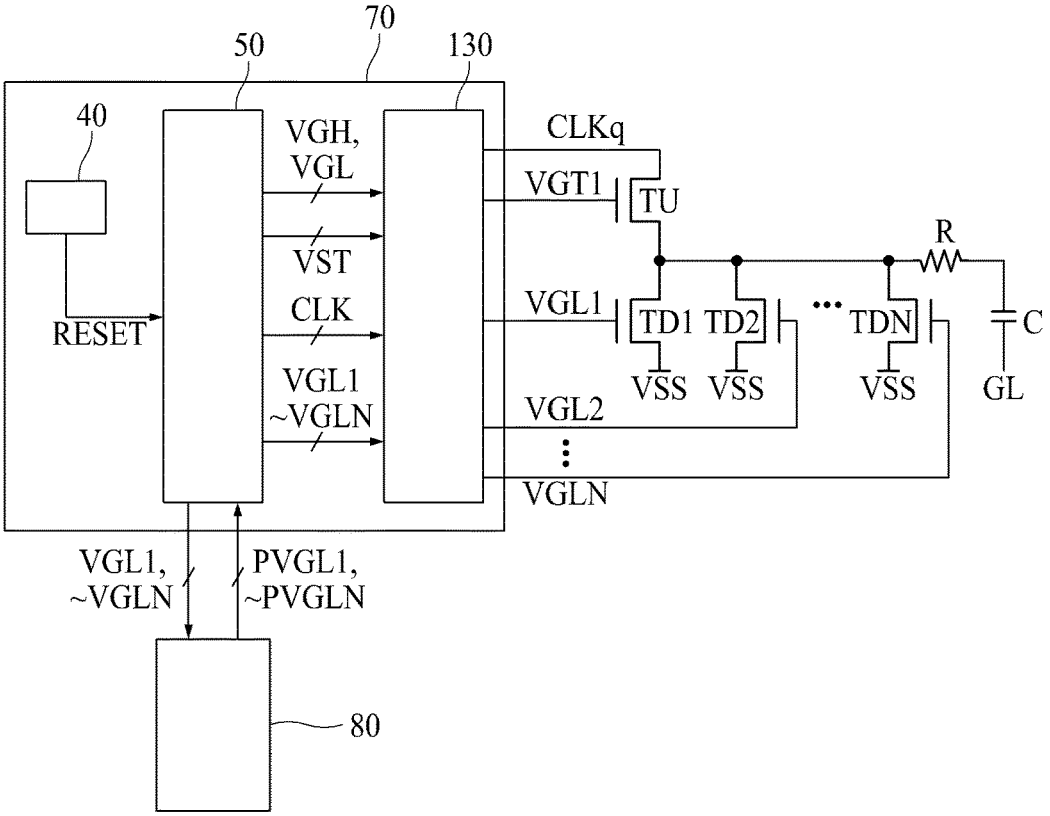
FIG. 13 is a block diagram illustrating a control printed circuit board, a pull-up transistor, and first to N-th pull-down transistors according to the fourth embodiment of the present disclosure.

FIG. 13 is a block diagram illustrating a control printed circuit board 70, a pull-up transistor (TU), and first to N-th pull-down transistors (TD1~TDN).

Unlike the display device according to the third embodiment of the present disclosure, the display device according to the fourth embodiment of the present disclosure is not set in such a way that the N-th pull-down transistor (TDN) is driven finally. When the display panel 10 is turned-on, the pull-down transistor which is not used finally for the previous driving is turned-on firstly.

The display device according to the fourth embodiment of the present disclosure needs information about the finally-driven transistor among the first to N-th pull-down transistors (TD1~TDN). To this end, if the reset signal (RESET) is supplied to the first signal correcting portion 50 of the display device according to the fourth embodiment of the present disclosure, the first signal correcting portion 50 detects that the finally-output frame at the final time point corresponds to the odd-numbered frame or the even-numbered frame. For the detection of the finally-output frame at the final time point, it is possible to generate information about which of the first to N-th pull-down transistors (TD1~TDN) is finally driven at the final time point.

The information about which of the first to N-th pull-down transistors (TD1~TDN) is finally driven at the final time point is stored when the display panel 10 is turned-off. For example, as shown in FIG. 13, the information about which of the first to N-th pull-down transistors (TD1~TDN) is finally driven at the final time point is stored in the set 80 at the time point when the display device enters the off-sequence stage, and the information about which of the first to N-th pull-down transistors (TD1~TDN) is finally driven at the final time point is loaded from the set 80 when the display device is turned-on, but not limited to this structure. For example, the information about which of the first to N-th pull-down transistors (TD1~TDN) is finally driven at the final time point may be stored in the internal memory of the first signal correcting portion 50 shown in FIG. 12.

In order to generate the information about which of the first to N-th pull-down transistors (TD1~TDN) is finally driven at the final time point, the first signal correcting portion 50 detects that the number of driven frames, that is, the number of frames which are outputted for the turn-on time period corresponds to the odd number or even number. To this end, the first signal correcting portion 50 uses the internal counter so as to count the number of driven frames.

According to the fourth embodiment of the present disclosure, if the information about which of the first to N-th pull-down transistors (TD1~TDN) is finally driven at the final time point is stored in the set 80, as shown in FIG. 13, the first signal correcting portion 50 supplies the first to N-th gate low voltages (VGL1~VGLN) to the set 80 at the time point when the reset signal (RESET) is supplied to the first signal correcting portion 50. According to the fourth embodiment of the present disclosure, if the information about which of the first to N-th pull-down transistors (TD1~TDN) is finally driven at the final time point is stored in the first signal correcting portion 50, the first signal correcting portion 50 generates the information about which of the first to N-th pull-down transistors (TD1~TDN) is finally driven at the final time point by the use of the first to N-th gate low voltages (VGL1~VGLN) generated in the first signal correcting portion 50 at the time point when the reset signal (RESET) is supplied to the first signal correcting portion 50, and then stores the generated information in the internal memory.

If the information about which of the first to N-th pull-down transistors (TD1~TDN) is finally driven at the final time point is stored in the set 80, the first signal correcting portion 50 transmits the first to N-th gate low voltages (VGL1~VGLN) to the set 80 through the use of I2C interface corresponding to an interface which transmits information to the set 80 and receives information from the set 80. The set 80 stores frame order information stored in the first to N-th gate low voltages (VGL1~VGLN).

If turning-on the display device after the turn-off state, the set 80 supplies the stored previous first to N-th gate low voltages (PVGL1~PVGLN) to the first signal correcting portion 50. Accordingly, the set 80 detects which of the first to N-th gate low voltages (VGL1~VGLN) corresponds to the voltage finally supplied from the first to N-th pull-down transistors (TD1~TDN). If it is turned-off under the circumstance that the k-th gate low voltage (VGLk, $1 \leq k \leq N$) is finally supplied thereto, the display device is turned-off until after the k-th pull-down transistor (TDk) is finally used.

Based on the detection result, the first signal correcting portion 50 starts to drive the pull-down transistor which is positioned just behind the finally-driven pull-down transistor.

If it is turned-off under the circumstance that the k-th gate low voltage (VGLk) is finally supplied thereto, the display device is turned-off until after the k-th pull-down transistor (TDk) is finally used. In this case, the (k+1)th pull-down transistor (TDk+1) is firstly turned-on and driven.

According as the pull-down transistor which is positioned just behind the finally-driven pull-down transistor for the previous driving is firstly used for the next driving in the display device according to the fourth embodiment of the present disclosure, it is possible to maintain the deterioration balance among the first to N-th pull-down transistors (TD1~TDN). According as the deterioration balance is maintained among the first to N-th pull-down transistors (TD1~TDN), it is possible to increase a lifespan of the display device.

According to the present disclosure, a lifespan of the gate driver is increased by maintaining the deterioration balance among the plurality of pull-down transistors.

It will be apparent to those skilled in the art that various modifications and variations can be made in the display device of the present disclosure without departing from the spirit or scope of the disclosure. Thus, it is intended that the present disclosure cover the modifications and variations of the disclosure provided they come within the scope of the appended claims and their equivalents.

What is claimed is:

1. A display device, comprising:

a display panel for displaying an image;

a gate driver for supplying a gate signal to the display panel, the gate driver including a plurality of stages, each stage including a plurality of pull-down transistors;

a timing controller for supplying a plurality of gate control signals to the gate driver; and a reset integrated circuit for supplying a reset signal to the timing controller, wherein the timing controller is configured to drive the display panel until an even-numbered frame, and to enter a reset mode until after a predetermined last one among the plurality of pull-down transistors inside the gate driver is driven, in a last even-numbered frame based on the reset signal supplied from the reset integrated circuit, the plurality of pull-down transistors being driven sequentially such that only one pull-down transistor among the plurality of pull-down transistors in each stage is driven in each frame, wherein the timing controller is configured to display a black image in the last even-numbered frame when an odd-numbered frame is finally driven by the reset signal, and not to display an image corresponding to digital video data when an even-numbered frame is finally driven by the reset signal, wherein the each stage includes first to N-th pull-down transistors, 'N' being an integer of 3 or more than 3, and wherein the timing controller is configured to drive the display panel to N multiple numbered frames, and to enter the reset mode after the N-th pull-down transistor among the first to N-th pull-down transistors is finally driven based on the reset signal.

2. The display device according to claim 1, further comprising a control printed circuit board for driving and controlling the display device, the control printed circuit board including:

the reset integrated circuit;

a first signal correcting circuit including the timing controller therein and supplied with the reset signal; and a second signal correcting circuit for supplying an even-numbered gate low voltage to a gate electrode of a first pull-down transistor of the plurality of pull-down transistors, and supplying an odd-numbered gate low voltage to a gate electrode of a second pull-down transistor of the plurality of pull-down transistors, based on even-numbered and odd-numbered notification signals supplied from the first signal correcting circuit.

3. The display device according to claim 1, wherein the display device is in a turned-off state after a highest even-numbered frame is driven, based on the reset signal.

4. The display device according to claim 2, wherein, when the reset signal is supplied to the first signal correcting circuit, digital video data is not outputted from the second signal correcting circuit after output of highest even-numbered gate low voltage.

5. The display device according to claim 2, wherein a black frame is inserted until a time point of driving the second pull-down transistor after a last odd-numbered gate low voltage is supplied.

6. The display device according to claim 2, wherein, when the reset signal is supplied to the first signal correcting circuit, the even-numbered and odd-numbered notification signals generated in the first signal correcting circuit are supplied to a set.

7. The display device according to claim 1, further comprising a control printed circuit board for driving and controlling the display device, the control printed circuit board including:

the reset integrated circuit;

a first signal correcting circuit provided with the timing controller therein and supplied with the reset signal; and a second signal correcting circuit for supplying first to N-th gate low voltages, 'N' being an integer of 3 or more than 3, to gate electrodes of first to N-th pull-down transistors of the plurality of pull-down transistors, based on even-numbered and odd-numbered notification signals supplied from the first signal correcting circuit.

8. The display device according to claim 7, wherein, when the reset signal is supplied to the first signal correcting circuit, digital video data is not outputted from the second signal correcting circuit after the output of the N-th gate low voltage.

9. The display device according to claim 7, wherein a black frame is inserted until a time point of driving the N-th pull-down transistor.

10. The display device according to claim 7, wherein, when the reset signal is supplied to the first signal correcting circuit, the first signal correcting circuit supplies the first to N-th gate low voltages to a set.

11. The display device according to claim 1, wherein the timing controller is configured to display the black image until a time point of driving the N-th pull-down transistor in the N multiple numbered frame.

12. A display device, comprising:

a display panel for displaying an image;

a gate driver for supplying a gate signal to the display panel, the gate driver including a plurality of stages, each stage including a plurality of pull-down transistors;

a timing controller for supplying a plurality of gate control signals to the gate driver; and a reset integrated circuit for supplying a reset signal to the timing controller, wherein the timing controller is configured to enter a reset mode until after a predetermined last one among the plurality of pull-down transistors inside the gate driver is driven, based on the reset signal supplied from the reset integrated circuit, the plurality of pull-down transistors being driven sequentially such that only one pull-down transistor among the plurality of pull-down transistors in each stage is driven in each frame, and wherein the timing controller is configured to first drive another pull-down transistor that has not been finally used in the previous driving among the plurality of pull-down transistors when the display panel is turned-on again after the reset mode.

13. The display device according to claim 12, wherein:

the each stage includes a first pull-down transistor and a second pull-down transistor, wherein the timing controller is configured to enter a reset mode until after the first pull-down transistor is driven based on the reset signal, and to first drive the second pull-down transistor when the display panel is turned-on again after the reset mode.

14. The display device according to claim 12, wherein:

the each stage includes first to N-th pull-down transistors, 'N' being an integer of 3 or more than 3, and wherein the timing controller is configured to enter a reset mode until after a k-th pull-down transistor among the first to N-th pull-down transistors, 'k' being greater than or equal to 1 and less than or equal to N, is finally driven based on the reset signal, and to first drive a (k+1)th pull-down transistor among the first to N-th pull-down transistors when the display panel is turned-on again after the reset mode.

15. The display device according to claim 14, further comprising a control printed circuit board for driving and controlling the display device, the control printed circuit board including:

the reset integrated circuit;

a first signal correcting circuit provided with the timing controller therein and supplied with the reset signal; and a second signal correcting circuit for supplying first to N-th gate low voltages to gate electrodes of the first to N-th pull-down transistors, based on even-numbered and odd-numbered notification signals supplied from the first signal correcting circuit.

16. The display device according to claim 15, wherein, when the reset signal is supplied to the first signal correcting circuit, the first signal correcting circuit supplies the first to N-th gate low voltages to a set.

* * * * *